US006863316B2

(12) United States Patent
Cole

(10) Patent No.: US 6,863,316 B2
(45) Date of Patent: Mar. 8, 2005

(54) DOOR LATCH MECHANISM AND ASSOCIATED COMPONENTS FOR A SELF-CLEANING OVEN

(75) Inventor: Ronald E. Cole, Greenwood, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/027,389

(22) Filed: Dec. 21, 2001

(65) Prior Publication Data

US 2003/0116974 A1 Jun. 26, 2003

(51) Int. Cl.[7] ..... E05C 19/12

(52) U.S. Cl. ..... 292/110; 292/110; 292/111; 292/129; 292/201; 292/229

(58) Field of Search ..... 292/111, 341, 292/201, 110, DIG. 69, 63, 229, 129; 170/DIG. 10; 126/191, 197

(56) References Cited

U.S. PATENT DOCUMENTS

| | | | | |
|---|---|---|---|---|
| 3,438,666 A | | 4/1969 | Erickson | |
| 3,462,584 A | * | 8/1969 | Guy | 219/412 |
| 3,610,883 A | | 10/1971 | Holtkamp et al. | |
| 3,745,988 A | * | 7/1973 | Frick | 126/273 R |
| 3,757,084 A | * | 9/1973 | McLean et al. | 219/413 |
| 3,831,580 A | | 8/1974 | McLean | |
| 3,859,979 A | | 1/1975 | Gilliom | |
| 3,875,372 A | * | 4/1975 | Gilliom | 219/413 |
| 3,912,904 A | | 10/1975 | Phifer | |
| 3,958,822 A | | 5/1976 | Germer | |
| 4,013,312 A | | 3/1977 | DeWeese | |
| 4,082,078 A | | 4/1978 | Thuleen | |
| 4,109,637 A | * | 8/1978 | Drouin | 126/197 |
| 4,133,337 A | | 1/1979 | Shea | |
| 4,136,667 A | * | 1/1979 | Lewis | 126/197 |
| 4,163,443 A | | 8/1979 | Peterson | |
| 4,345,144 A | * | 8/1982 | Bergquist | 219/413 |
| 4,364,589 A | | 12/1982 | Watson | |
| 4,374,320 A | * | 2/1983 | Barnett | 219/413 |
| 4,510,777 A | * | 4/1985 | Ellingson et al. | 68/12.26 |
| 4,554,907 A | | 11/1985 | Overley et al. | |
| 4,593,945 A | * | 6/1986 | Arute et al. | 292/201 |
| 4,745,250 A | | 5/1988 | Mayo | |
| 4,838,586 A | | 6/1989 | Henne | |
| 4,862,870 A | | 9/1989 | Fox | |
| 4,927,996 A | | 5/1990 | Genbauffe | |
| 5,029,910 A | * | 7/1991 | Genbauffe et al. | 292/110 |
| 5,062,668 A | * | 11/1991 | Onderka et al. | 292/25 |
| 5,072,974 A | * | 12/1991 | Henne | 292/126 |
| 5,220,153 A | | 6/1993 | Malone | |
| 5,419,305 A | | 5/1995 | Hanley | |
| 5,440,103 A | | 8/1995 | Martin | |
| 5,477,030 A | | 12/1995 | Buckshaw et al. | |
| 5,493,099 A | | 2/1996 | McWilliams, III | |
| 6,079,756 A | * | 6/2000 | Phillips | 292/198 |
| 6,302,098 B1 | * | 10/2001 | Smith | 126/197 |
| 6,315,336 B1 | * | 11/2001 | Swartzell | 292/201 |
| 6,474,702 B1 | * | 11/2002 | Malone et al. | 292/97 |

FOREIGN PATENT DOCUMENTS

FR EPA 0348319 * 6/1989

* cited by examiner

*Primary Examiner*—Daniel P. Stodola
*Assistant Examiner*—Carlos Lugo
(74) *Attorney, Agent, or Firm*—Maginot, Moore & Beck

(57) ABSTRACT

A door latching or locking mechanism or module for a self-cleaning oven includes latching linkage of the door latch module that enables use of lighter duty, less expensive motor. The mechanical advantage and vector optimization of the latching linkage avoids stalling especially from a locked position. The latching mechanism includes a plurality of switches having a corresponding plurality of terminals. The terminals are grouped or ganged to allow connection with a single connector interface. The switches are selectively actuable/de-actuable by a cam and cam plate that utilizes linear motion translated from rotational motion of a driven (motor) to selectively actuate and/or de-actuate the switches.

16 Claims, 22 Drawing Sheets

S1 – SWITCH CONTACTS TO CLOSE WHEN OVEN DOOR IS CLOSED

S2 – SWITCH CONTACTS TO CLOSE WHEN OVEN DOOR IS CLOSED

S3 – SWITCH CONTACTS CLOSE WHEN IN LOCK (CLEAN MODE) POSITION

DOOR LATCH MECHANISM AND ASSOCIATED COMPONENTS FOR A SELF-CLEANING OVEN

CROSS REFERENCE

Cross reference is made to copending U.S. patent application Ser. No. 10/027,542, entitled "Door Latch Mechanism and Associated Components for a Self-Cleaning Oven" by Ronald E. Cole which is a signed to the same assignee as the present invention, and which was filed concurrently herewith on Dec. 21, 2001.

FIELD OF THE INVENTION

The present invention relates generally to self-cleaning ovens, and more particularly, to a door latch mechanism and associated aspects thereof for self-cleaning ovens.

BACKGROUND

Ovens that are self-cleaning are well known. Such self-cleaning ovens include a cleaning mode or cycle that is initiated by a user. The self-cleaning cycle generates intense heat inside the oven. The intense heat reduces food particles, grease, spills and splatter (collectively, build-up) inside the oven to ash. Once the cleaning cycle is complete, the resulting ash may then be easily wiped away.

Because of the intense heat necessary to reduce such build-up to ash, self-cleaning ovens lock the oven door during the cleaning cycle to prevent access thereto. Self-cleaning ovens thus include a locking mechanism that keeps the oven door shut and locked during the cleaning cycle. While the locking mechanism may be manually actuated, most locking mechanisms in current self-cleaning ovens are automatically actuated when the self-cleaning mode is selected.

Such locking mechanisms include a latch that is controlled by the motor. The latch cooperates with a lock jamb in the door of the oven to lock the door when the door is in a closed position. The latch, via the motor, creates a compressive force between the door and the oven. This seals the oven door against the oven. Tolerance stack-up on doors, frames and hinges of the oven uses up the compressibility of the seal of the door and can cause current locking mechanisms to undesirably stall.

Current oven designs thus cause oven manufacturers to want a locking mechanism that has high strength and low cost. Strength or force has also begun to be associated with the position of the latch with respect to the door lock jamb. Higher strength or force for the locking mechanism translates into a higher cost. In order to lower the price for such locking mechanisms, force requirements have been eroded. Since over half the cost of such locking mechanisms is in the gear motor, reducing force requirements reduces the size of the motor necessary to achieve the required force by the latch. As an example, the following table (Table 1) illustrates how such force requirements have been eroded.

TABLE 1

| Date | Stroke | Dimension Tolerance | Force |
|---|---|---|---|
| 7/98 | 0.8" | 0.075" | 12 lbs |
| 2/00 | 0.65" | 0.100" | 4 to 6 lbs |
| 4/00 | 0.54" | 0.090" | 3 to 4 lb |

It is known art to drive or actuate the latch of the locking mechanism directly from the motor of the locking mechanism via lock levers. However, even with the reduction of force requirements and such direct drive mechanisms, the problem of stalling of the latch is still present.

In addition to providing a latching function, current locking mechanisms provide switches that control various aspects of the oven associated with or because of the self-cleaning mode. The switches in such current locking mechanisms are actuated via a radial (drum) cam that is driven by the motor. A radial or drum cam has a thickness or stack in proportion to the number of switches associated with the locking mechanism. A problem with such radial cams is that the thickness (height) of the drum stack would become too large to package the many switches that are now part of the locking mechanism in a convenient ganged array if the drum stack is too large, the locking mechanism becomes too thick for useful or practical packaging for ovens.

Therefore, each one of the many switches located on the locking mechanism requires two terminals (a set of terminals). Each set of terminals needs to be coupled to a controller or other component of the oven. Currently, each terminal of each set of terminals is connected to the controller or other component via an individual spade connector. During assembly, each spade connector must therefore be connected individually. This can present a problem of correctly connecting the various spade connectors.

What is therefore needed is a door locking mechanism for a self-cleaning oven that overcomes the disadvantages of the prior art. What is further needed is a door locking mechanism for a self-cleaning oven that is low cost, provides enough strength (force) for door closure retention, provides little or no stall, accommodates a plurality of switches, and is low-profile. What is therefore further needed is a door locking mechanism for a self-cleaning oven that can be retrofitted into existing self-cleaning oven models.

SUMMARY

The present invention is a door latch mechanism and/or module for a self-cleaning oven. The door latch module is operative in one mode to securely latch or catch the oven door and in another mode to allow free movement of the oven door. The door latch module is adapted to be automatically driven. The door latch module includes and/or performs various features and/or functions.

According to an aspect of the subject invention, the door latch module includes reciprocating mechanical latching linkage that drives a latching hook. The latching hook cooperates with a latch catch in the oven door to retain the oven door in the one mode of operation. The mechanical latching linkage is configured as common pivot arms that provide a scissors action that reciprocates through a drive arm. The drive arm is coupled to a rotating member. Rotational movement of the rotating member is translated into near-linear, planar movement (latching movement) of the latching hook through the drive arm and the pivot arms.

In this manner, a class N (or other) motor may be used as a driver. Additionally, the latching linkage is configured to decrease latch speed at clamping or latching point. This increases the mechanical advantage at a clamping. As well, the likelihood of stalling is reduced. Further, the present latching linkage requires less torque to operate.

According to another aspect of the subject invention a door latch module includes a plurality of switches. The plurality of switches, in turn, have a corresponding plurality of terminals. The plurality of terminals for the door latch module are ganged or grouped to permit coupling with a single terminal interface. The single terminal interface may be configured to accept a modular plug. The modular plug may include releasable catches or the like.

According yet to another aspect of the subject invention, a door latch module includes a cam plate that is operative to selectively actuate and/or de-actuate select switches of the plurality of switches. The cam plate is driven by a driver (such as a motor) during the cleaning cycle or mode. The cam plate translates rotational motion of the motor to linear motion to actuate and/or de-actuate the switches.

In one form, the subject invention is a door latch module for a self-cleaning oven. The door latch module includes a support adapted to be mounted to the self-cleaning oven. The support maintains a motor, a latching mechanism, a plurality of switches, and a plurality of terminals. The motor drives the latching mechanism. The plurality of terminals associated with the plurality of switches are configured to connect to a single terminal interface.

In another form, the subject invention is a door latch for a self-cleaning. The door latch includes a support adapted to be mounted to a self-cleaning oven, a cam maintained by the support, a cam plate coupled to and driven by the cam, and a motor coupled to the cam and operative to drive the cam. The door latch also includes a latch mechanism coupled to and driven by the motor, a plurality of switches maintained on the support and selectively actuated by the cam plate, and a plurality of terminals associated with the plurality of switches and maintained on the support. The plurality of terminals are ganged to permit connection to a single terminal interface.

In yet another form, the subject invention is a door latch mechanism in a self-cleaning oven, the self-cleaning oven having door hingedly attached to a frame, and a controller operative to control the self-cleaning oven. The door latch mechanism includes a support coupled to the frame proximate the door. A rotating cam is maintained by the support. A motor is coupled to the rotating cam and is operative to drive the rotating cam. A cam plate is coupled to the rotating cam and is driven by the rotating cam. A latch mechanism is coupled to and driven by the motor. The latch mechanism is driven by the motor to lock the door during a locking mode and to allow free movement of the door during a non-locking mode. A plurality of switches are maintained on said support. A plurality of terminals are associated with the plurality of switches and are maintained on the support. The plurality of terminals are ganged to permit connection to a single point terminal connector.

BRIEF DESCRIPTION OF THE DRAWINGS

The above-mentioned and other features and advantages of this invention, and the manner of attaining them, will become more apparent and the invention will be better understood by reference to the following descriptions of embodiments of the invention taken in conjunction with the accompanying drawings, wherein.

Corresponding reference characters indicate corresponding parts throughout the several views.

DETAILED DESCRIPTION

Figure 1:
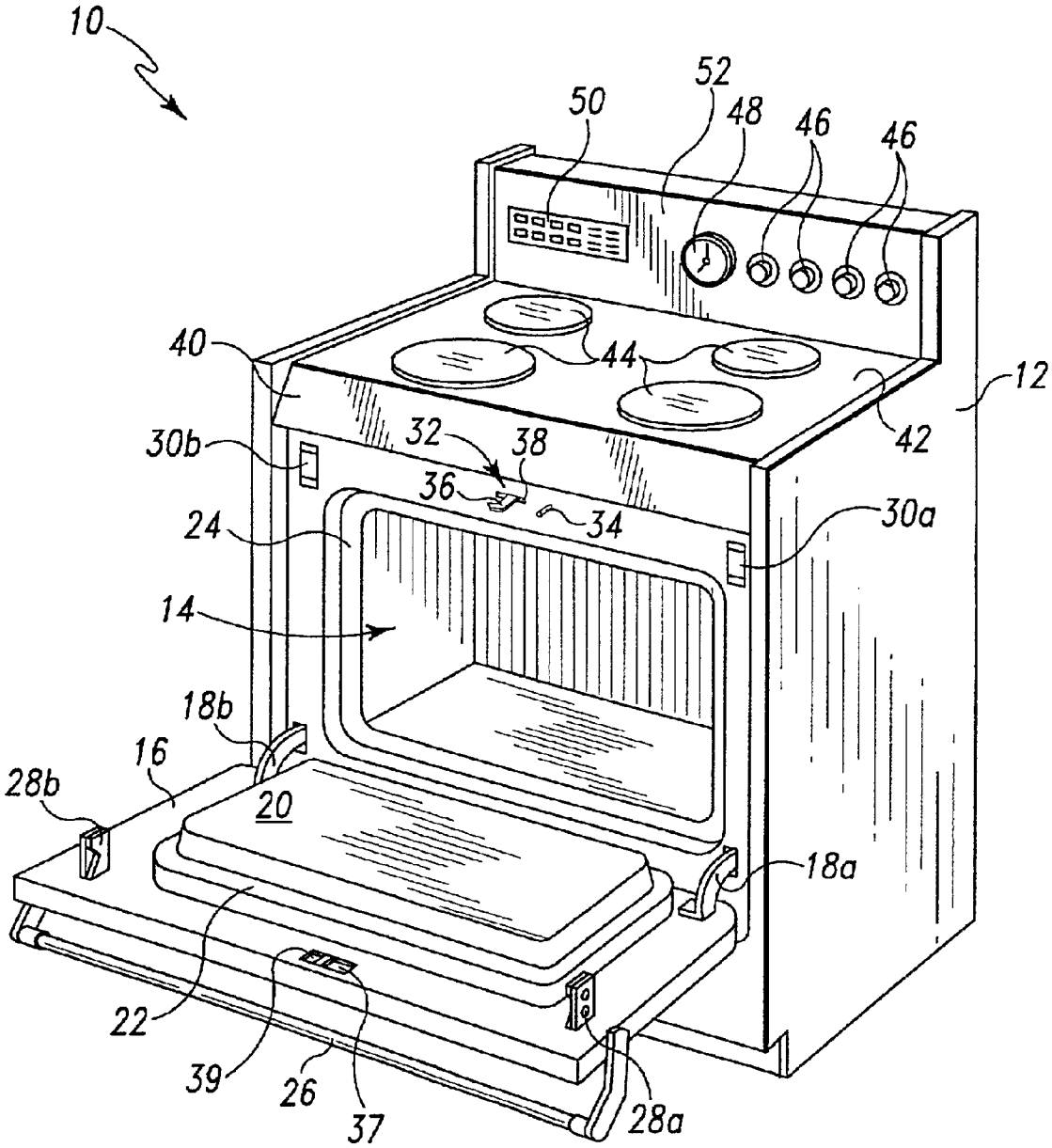
FIG. 1 is a perspective view of an oven embodying various inventions according to the principles presented herein.

Referring to FIG. 1, there is depicted an oven, range, or stove (and as used hereinafter, collectively oven) generally designated 10, representing all forms of ovens, ranges, and stoves in which the subject inventions may be embodied. The oven 10 has a frame or body 12 that defines an oven portion or cooking chamber 14. The cooking chamber includes cooking elements (not shown) such as resistive heating elements, or the like such as is known. A door 16 is attached to the frame 12 by at least two hinges 18*a* and 18*b* that extend into the frame 12. The door 16 is adapted to open and close relative to the cooking chamber 14. Particularly, the door 16 is adapted to pivot into open and closed positions relative to the cooking chamber 14. The hinges 18*a* and 18*b* extend into the frame 12 and are configured to allow the door 16 to open and close. The hinges 18*a* and 18*b* also stop movement of the door 16 at the position shown in FIG. 1 (a fully open position). While not shown, the door 16 may include a longitudinal hinge along a bottom edge of the door 16 between the hinges 18*a* and 18*b* that is attached to the frame 12.

The door 16 has an inset portion 20 that is sized to fit the opening of the cooking chamber 14. The door 16 also includes a raised rim 22 that is disposed about the inset portion 20. The raised rim 22 is configured to abut a ledge 24 that is inset from and surrounds the perimeter of the opening of the cooking chamber 14. The raised rim 22 and/or the ledge 24 preferably have a compressive seal (not shown) thereabout that abuts the other when the door 16 is in a closed position. When the door 16 is in the closed position, the raised rim 22 abuts the ledge 24 while the inset portion 20 extends into the cooking chamber 14. In this manner, heat produced within the cooking chamber 14 tends to stay therein with minimal to no heat loss or leakage from or about the door 16.

The door 16 may also include hook mechanisms 28*a* and 28*b* disposed on upper corners of the door 16 that correspond to hook receiving mechanisms 30*a* and 30*b* in the frame 12. The hook receiving mechanisms 30*a* and 30*b* are positioned in the frame 12 proximate the cooking chamber 14 to receive the respective hook mechanism 28*a* and 28*b* of the door 16, when the door 16 is closed. The hook mechanism 28*a* and 28*b* may be coupled to or associated with the handle 26 so as to operate in conjunction therewith. One form, movement of the handle 26 moves the hook mechanisms 28*a* and 28*b* which cooperate with the hook receiving mechanisms 30*a* and 30*b* when the door 16 is in the closed position to releasably maintain the door 16 to the frame 12. In this example, movement of the handle 26 during opening of the door 16 releases the hook mechanisms 28*a* and 28*b* from the hook receiving mechanism 30*a* and 30*b* respectively to allow opening of the door 16 relative to the frame 12 and cooking chamber 14.

The oven 10 also includes a top surface 42 that supports four (4) burners or heating elements 44 of any type (i.e. resistance, induction, or the like). It should be appreciated that there may more or less burners or elements as desired by the manufacturer but four are typical. Adjacent the top surface 42 is a console 52 that supports four controllers 46, one for each burner. Each controller 46 is operative to turn on and off a burner as well as set the temperature thereof. The console 52 also supports a clock 48 and a control/selector panel 50. The control/selector panel 50 is operative to allow the user to select various modes of the oven 10 and display various information regarding those modes and/or cycles of the range in general. More particularly, the control selector panel 50 is operative to allow the user to set, without being exhaustive, such modes as the cleaning cycle, baking, broiling, temperature setting/control for baking broiling, and the like.

Figure 2:
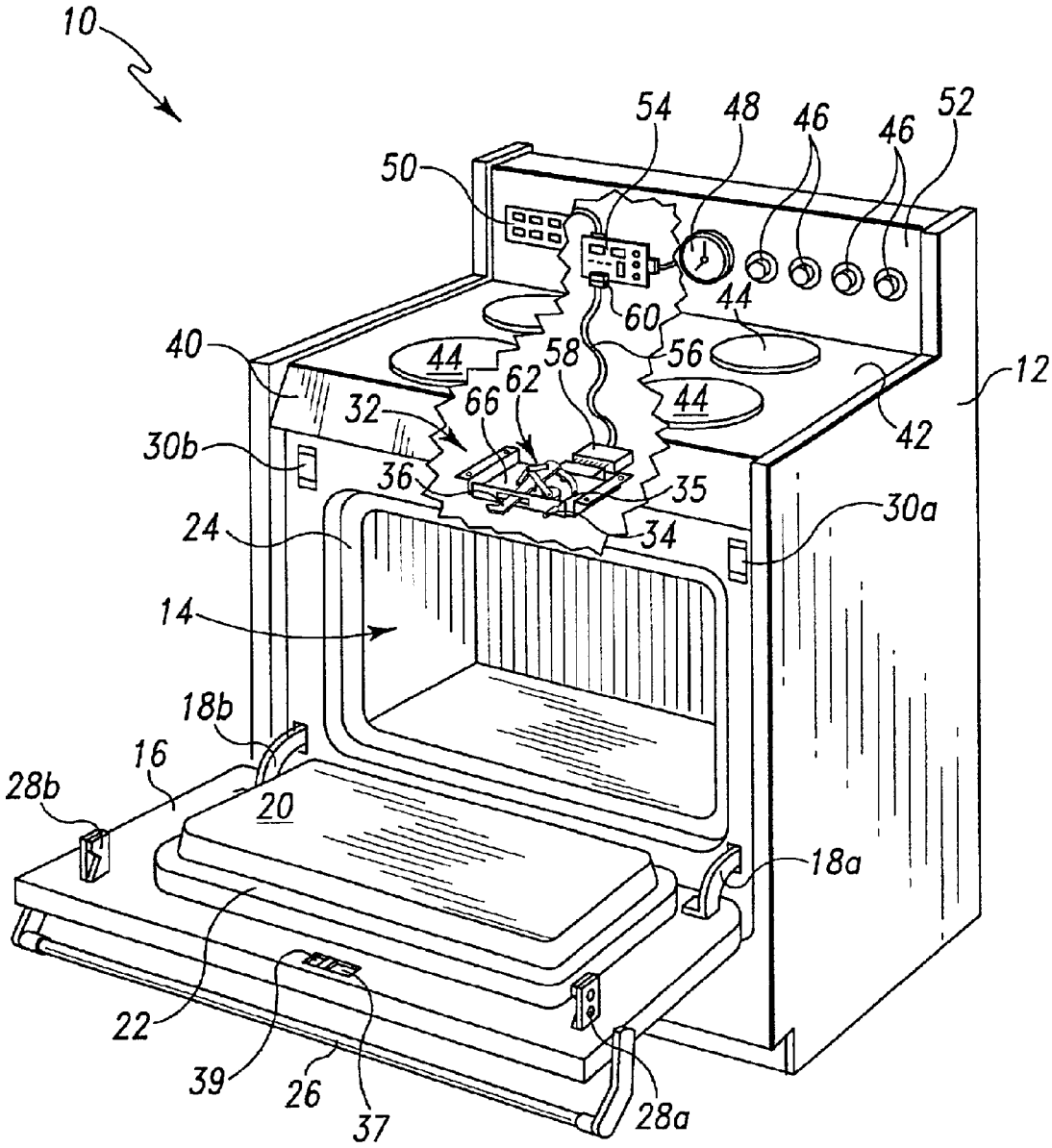
FIG. 2 is a perspective view of the oven of FIG. 1 with a partial cutaway section showing an exemplary door latch mechanism and/or module in communication with an oven controller.

With additional reference to FIG. 2 and in accordance with an aspect of the subject invention, the oven 10 also includes a door latch mechanism or module 32 (hereinafter collectively, module). The door latch module 32 is typically, and as shown herein, mostly disposed within the frame 12. As particularly shown herein, the door latch module 32 is behind the front panel 40 and under the top surface 42. It should be appreciated that while the door latch module 32 is shown disposed at a front side of the oven 10, the door latch module 32 may be situated at a rear side of the oven 10. The door latch module 32 may be thought of as modular. This allows the present door latch module 32 to retrofit existing door latch mechanisms.

The door latch module 32 is operative to secure and/or securely latch the door 16 against the frame 12 when the oven 10 is in the cleaning mode/cycle in order to keep the door 16 about the cooking chamber 14. When the oven 10 is not in the cleaning mode/cycle, the door latch module 32 is operative to allow the door 16 to freely open and close relative to the cooking chamber 14. The door latch module 32 is under control of the oven 10 as described in greater detail below.

The door latch module 32 is in communication with a main controller, control logic/circuitry, processor, processing unit, processing circuitry/logic and/or control board 54 (hereinafter collectively, main controller) of the oven 10 via a communication line or conductor such as cable 56. The cable 56 has a plurality of wires, electrical conductors, and/or optic conductors (hereinafter collectively, conductors) that terminate at one end in a single housing interface 58 (e.g. and hereinafter, a modular plug) and at another end in another preferably single housing interface 60 (e.g. and hereinafter, a modular plug). The modular plug 58 and or the modular plug 60 may be a quick connect/disconnect type plug. This aids in reducing and/or eliminating wiring mix-ups as compared to single spade type connectors.

The modular plug 58 is coupled to the door latch module 32 while the modular plug 60 is coupled to the main controller 54. More particularly, and as described in greater detail below, the modular plug 58 has a plurality of connecting conductors that releasably couple to a plurality of terminals of the door latch module 32. As described in greater detail below, the plurality of terminals (see e.g. FIG. 3) of the door latch module 32 are coupled to switches and/or other components thereof. The modular plug 60 likewise has a plurality of connecting conductors that releasably couple to a plurality of terminals (not shown) of the main controller 54. The plurality of connectors of the main controller 54 are coupled to the various components and/or circuitry/logic of the main controller 54. The main controller 54 is in communication with the control/selector panel 50, the controllers 46, and other various components as are typical of ovens and/or similar appliances.

The door latch module 32 has a door position pin 34 that is part of a door position switch 35. The door position pin 34 extends from the door position switch 35 through a hole 72 in the front panel 40 (see FIG. 3). The door position pin 34 is operative to detect position of the door 16. Particularly, the door position pin 34 is operative to detect whether the door 16 is closed (i.e. the door 16 rests against the frame 12 and covers the cooking chamber 14) and/or whether the door 16 is open (i.e. the door 16 ranges from being ajar a small distance from and relative to the frame 12 to being fully open and down). While the opposite may be applied to the present case, the door position pin 34 is shown and assumed herein to be biased outward toward the door 16. The door position switch 35 via the door position pin 34 is thus operative to indicate whether the door 16 is open or closed.

In the present case, contact of the door 16 against the door pin 34 actuates the door position switch (either opens or closes the door switch 35 depending on the electrical configuration of the switch, i.e. a normally-open or normally-closed type switch). The opening or closing of the door position switch 35 by actuation of the door 16 against the door position pin 34, provides a door open/close signal to the main controller 54. It should be appreciated that the door position switch 35/door position pin 34 may take other forms that indicate whether the door is open.

The door latch module 32 includes a latch, latching, or hook mechanism 62 (hereinafter and collectively, latch mechanism 62) that is in communication with a motor 64 (see, e.g. FIG. 3). The latch mechanism 62 is driven by the motor 64 (i.e. the latch mechanism 62 moves through movement of the motor 64). The latch mechanism 62 includes a hook or hook portion 36. The hook 36 normally extends from a slot 38 in the front panel 40 of the oven 10. The door 16 includes an opening 37 in which is disposed a bar or the like 39 that is positioned so as to be adjacent the slot 38 when the door 16 is closed. When the door 16 is closed and the oven 10 is in a normal operating mode (i.e. not in the cleaning mode/cycle), the hook 36 extends slightly into the opening 37 but does not engage the bar 39. The motor 64 causes the hook 36, via the latching mechanism 62 to engage the bar 39 when the oven 10 is put into the cleaning mode. When the cleaning mode is complete, the hook 36 is caused to disengage the bar 39 via the motor 64 acting on the latching mechanism 62. Thereafter, the hook 36 returns to its normal position.

Power for the oven 10 is provided via a power cord (not shown) that is configured to be plugged into an appropriate source of electricity (i.e. a line voltage), typically a 120 volt AC source or a 240 volt AC source (not shown). The various components of the oven 10 are thus configured, adapted, and/or operative to operate on the line voltage or an appropriately transformed power (voltage and/or current) by appropriate transformers and/or transformer circuitry/logic.

Figure 3:
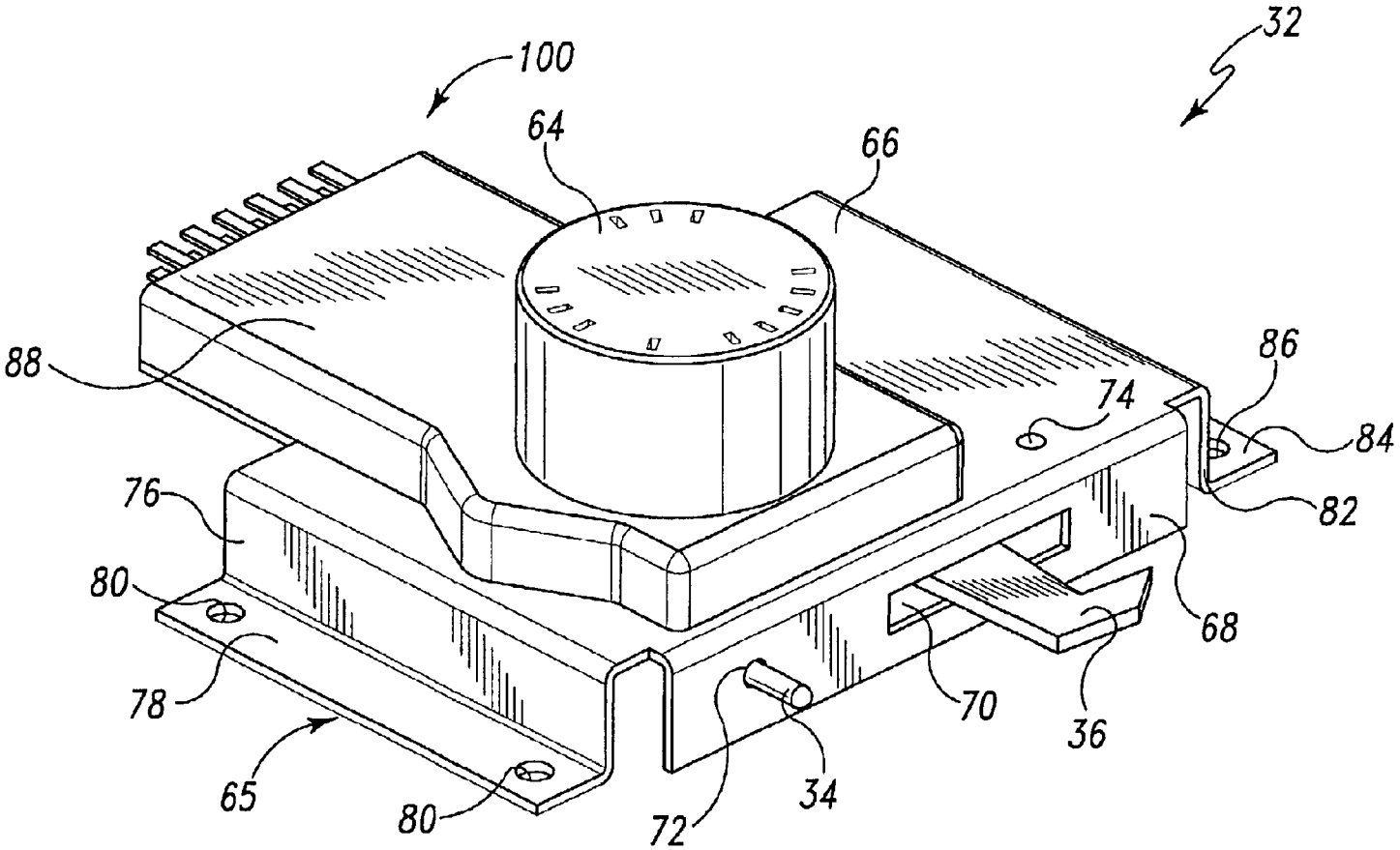
FIG. 3 is a top perspective view of an exemplary door latch module.
Figure 4:
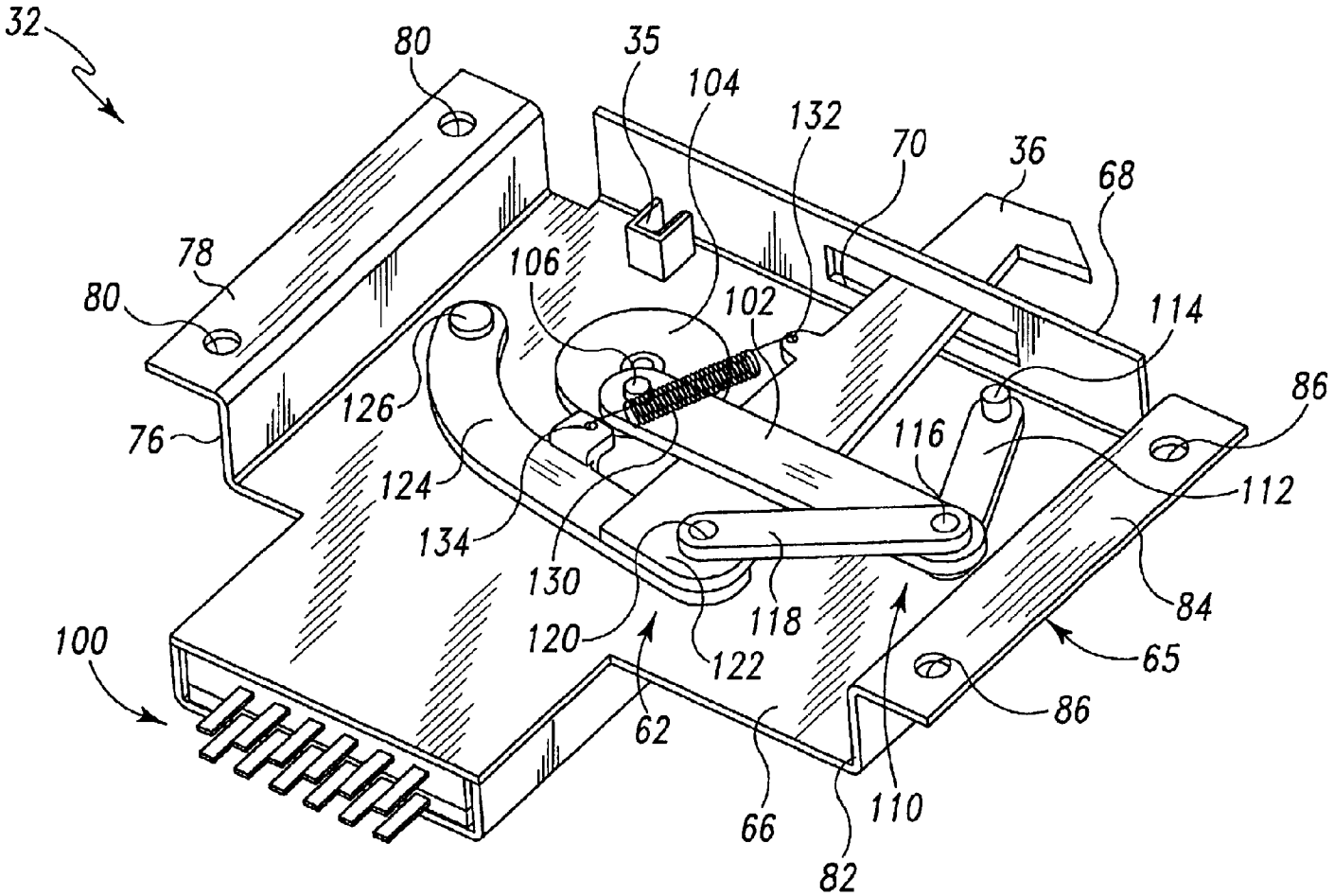
FIG. 4 is a bottom perspective view of an exemplary door latch module.
Figure 5:
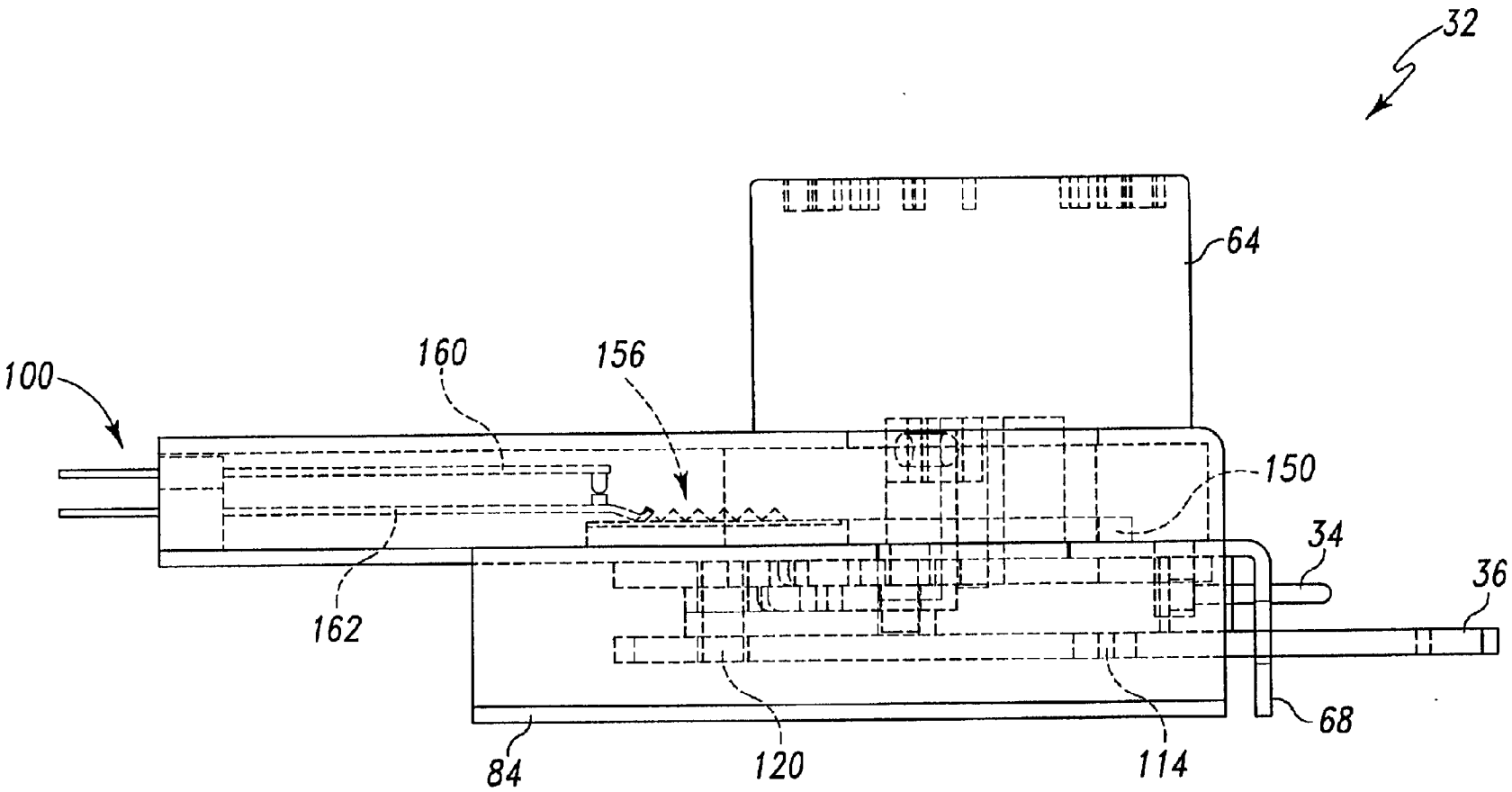
FIG. 5 is a side view of an exemplary door latch module.
Figure 6:
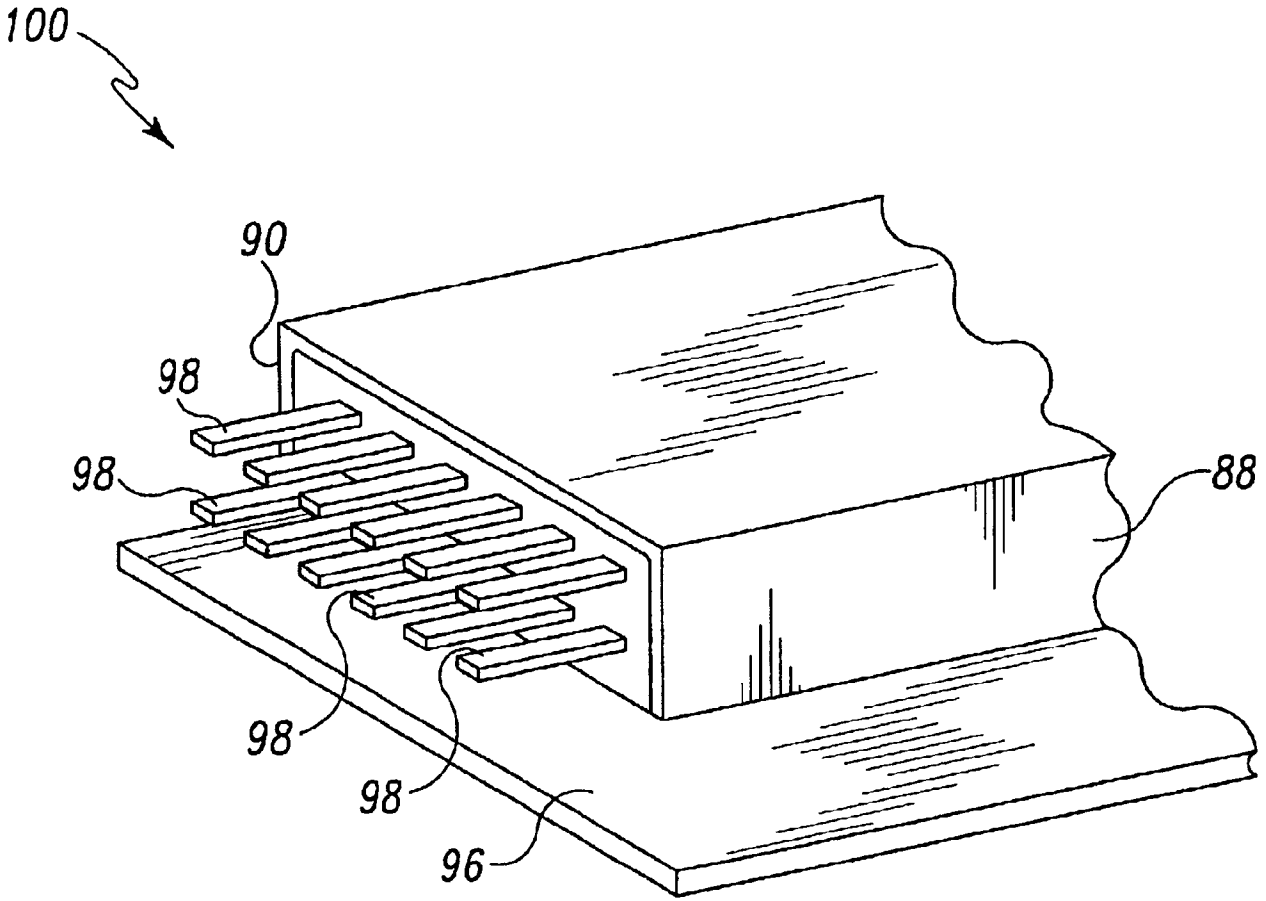
FIG. 6 is an enlarged partial cutaway view of a plurality of terminals associated with an exemplary door latch module.

Referring to FIGS. 3–6, there is shown the door latch module 32 from various angles. In particular, FIG. 3 depicts a perspective view of one side of the door latch module 32, FIG. 4 depicts a perspective view of another side of the door latch module 32, FIG. 5 depicts a side view of the door latch module 32, and FIG. 6 depicts an enlarged perspective view of a terminal bank of the door latch module 32 in accordance with an aspect of the present principles.

The door latch module 32 has a housing 65 that is shown in an exemplary manner as a plate 66. The plate 66 defines a support or frame for at least some of the various components of the door latch module 32. The door latch module 32 may thus be considered as a module or component of the oven 10. As shown in FIG. 2, the plate 66 is adapted and/or configured to be mounted to the frame 12 of the oven 10. The plate 66 has a front flange or side 68 that defines an essentially flat face or surface. The front flange 68 is essentially perpendicular to a plane defined by the plate 66. A slot 70 is formed in the flange 68 that is sized, configured, and/or adapted to allow the hook 36 to extend therethrough. The slot 70 is of a height and longitudinal length that allows the movement of the hook 36 within the slot 70. Particularly, the slot 70 is configured to allow the hook 36 to move in a side-to-side direction (longitudinal direction) therein as well as in and out relative to the face of the flange 68 (essentially perpendicular to the longitudinal length of the slot 70). As discussed in detail below, movement of the hook 36 is accomplished during the cleaning mode or cycle of the oven 10.

The flange 68 also has an opening 72 through which extends the door pin 34 of the door switch 35. The opening 72 is sized and/or configured to allow the reciprocal movement of the door pin 34 therethrough. The door pin 34 is biased into either an open-switch or closed-switch position depending on the type of switch and its wiring and/or application. As best seen in FIGS. 1 and 2, the pin 34 in the present example is biased into an open-switch position. In this manner, the pin 34 is normally out (extended) when the door 16 is open, and in (depressed) when the door 16 is closed.

Figure 13:
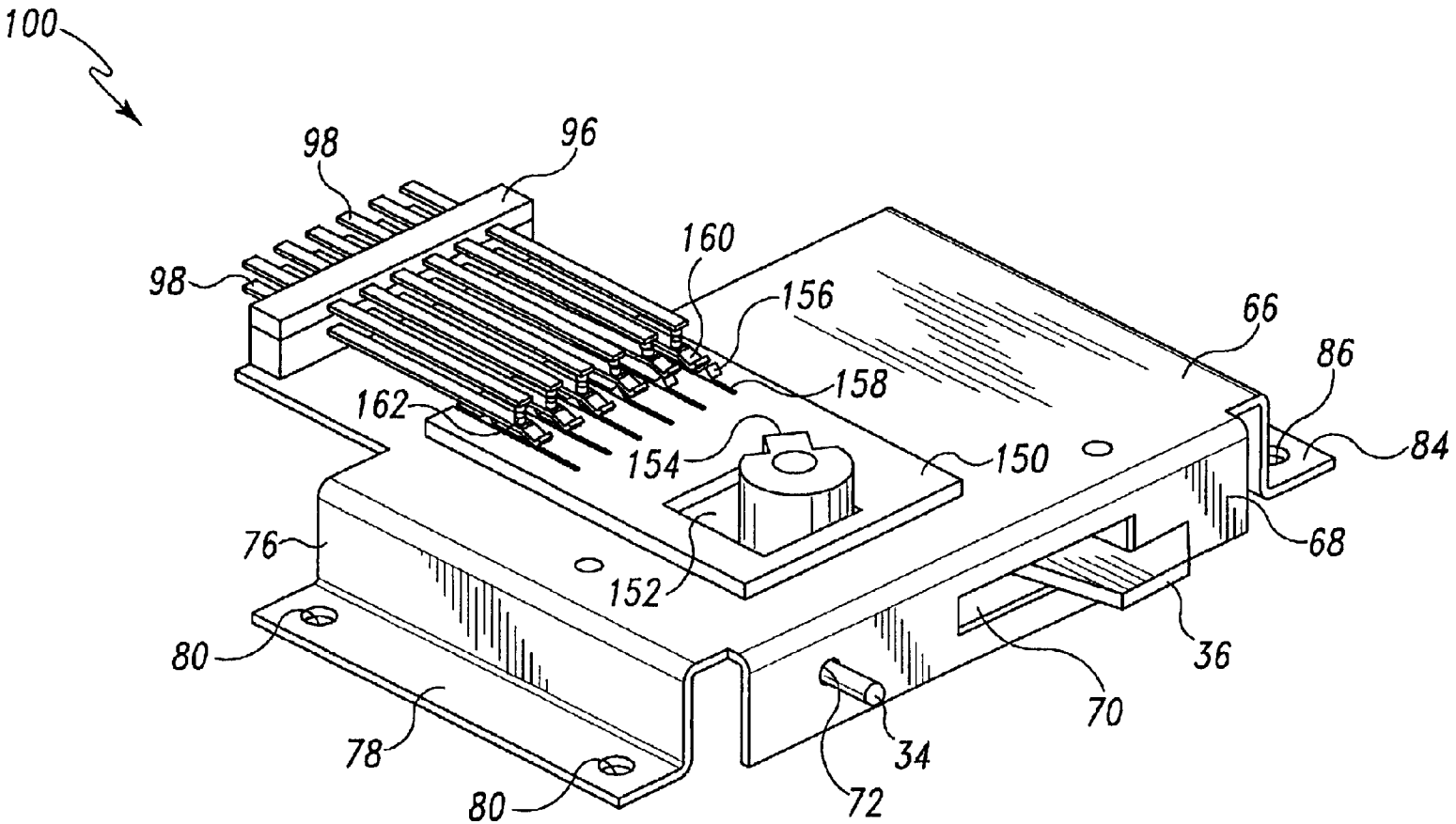
FIG. 13 is a top perspective view of an exemplary door latch module with the latching linkage in a fully closed position and with the cover and motor removed particularly showing positioning of the cam and cam plate.
Figure 14:
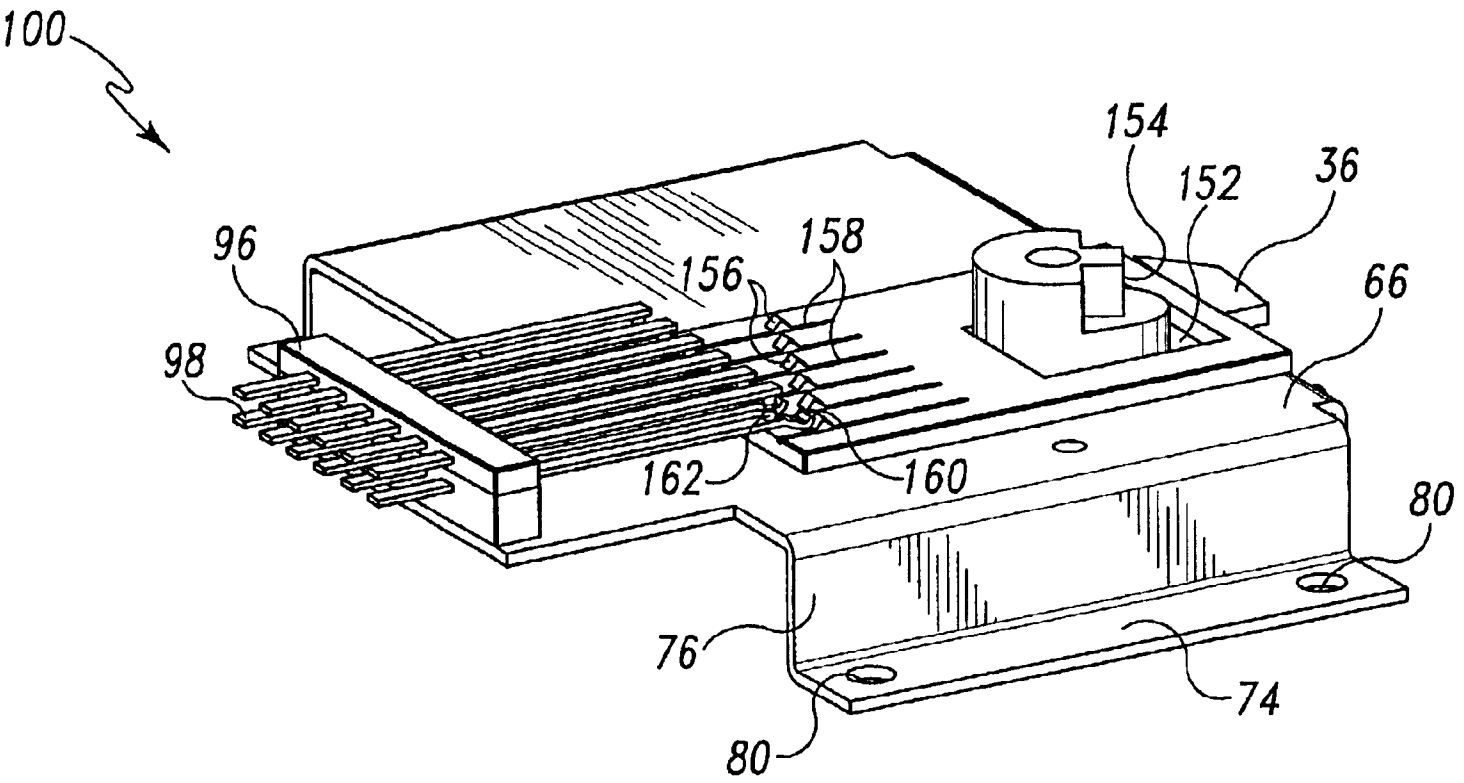
FIG. 14 is an enlarged side perspective view of an exemplary door latch module particularly showing the cam and cam plate relative to the switches when the cam and cam plate are in an open or unlatched position.

The plate 66 further includes a number of holes or bores 74 defined therein (see, e.g., FIGS. 3 and 13). Moreover, the flange 68 abuts the inside surface (not shown) of the panel 40 when the locking mechanism 32 is mounted to the oven 10.

The plate 66 also has a first side extension 76 and a second side extension 82 that is opposite the first side extension 76. The first and second side extensions 76 and 82 are essentially perpendicular to the plane defined by the plate 66. The first side extension 76 has a first outward flaring flange 78 that includes mounting holes 80 that are adapted and/or configured to allow screws, bolts, or other fasteners (not shown) to extend therethrough and be held by the flange 78. The mounting holes 80 and the fasteners cooperate to allow the door latch module 32 to be mounted to the oven 10. The second side extension 82 has a second outward flaring flange 84 that includes mounting holes 86 that are adapted and/or configured to allow screws, bolts, or other fasteners (not shown) to extend therethrough and be held by the flange 84. The mounting holes 86 and the fasteners cooperate to allow the door latch module 32 to be mounted to the oven 10. As shown in FIG. 2, the plate 66 (and thus the door latch module 32) is adapted to be mounted to the oven 10 adjacent the front panel 40 via the mounting holes 74, 80, and 86 of the flanges 68, 78, and 84 respectively. It should be appreciated that the mounting configuration is only exemplary of a manner in which the door locking mechanism 32 is mountable to the oven 10. Other mounting configurations are thus contemplated.

As best seen in FIG. 3, the door latch module 32 also has a motor 64 that is situated over a cover 88. The motor 64 is electrically coupled to various and appropriate terminals 98 of the terminal bank 100 (see FIG. 6) in order to receive electricity and/or control signals. As described further below, the motor 64 provides a driving mechanism or driver for various features and/or mechanisms of the door latch module 32. With reference to FIG. 6, the terminals 98 are held via a retainer 96 within or flush with an opening 90 of the cover 88. The opening 90 and/or the retainer 96 define a single terminal interface for the door latch module 32. The single terminal interface may be embodied in a modular plug, connector, or the like. The modular plug is preferably a quick connect/disconnect type, however, any suitable type of plug or connector may be used.

In FIG. 4, the latch mechanism 62 is more particularly shown. The latch mechanism 62 may also be thought of as latch or latching linkage. The latching linkage 62 is formed of various members or links that are pivotally and/or fixedly coupled in the manner shown in the figures and/or described herein. The latching linkage 62 is coupled to the motor (driver) 64 via a motor shaft 108 that defines an axis of rotation. Particularly, the latching linkage 62 is coupled to the motor 64 via a rotational or rotating member 104. The rotating member 104 may be a disk or a cam. A drive arm link 102 is pivotally fixed at 106 to the rotating member 104. The drive arm link 102 reciprocates substantially back and forth as the rotating member 104 rotates.

The drive arm link 102 is pivotally coupled at 116 to a scissors mechanism or linkage 110. The scissors mechanism 110 is in turn pivotally coupled to a hook arm 122 and swing arm 124, with the hook arm 122 terminating in the hook 36. The scissors mechanism 110 includes a first link arm 112 that is pivotally attached at one end to a fixed point 114 so as to pivot or swing therefrom, and at a second end to the pivot 116. The scissors mechanism 110 also includes a second link arm 118 that is preferably fixed at but may be pivotally attached at one end to a pivot 120, and at another end at the point (pivot) 116. The swing arm 124 is pivotally (but may be fixedly or as a piece integral with the hook arm 122) coupled at one end thereof to the hook arm 122 distal the hook 36 and pivotally coupled to one another and the second arm 118. The swing arm 124 is further pivotally coupled at another end to a fixed point 126. The swing arm 124 further includes a stop 125 that prevents travel of the hook arm 122 too far thereagainst.

As the rotating member 104 rotates in response to being driven by the motor 64, the drive arm 102 pulls and pushes the scissors mechanism 110 via the pivot 116. The second arm 118 thus pulls and pushes the hook arm 122 against the bias of the spring 130 and the swing arm 124. Movement of the hook arm 122 provides movement of the hook 36 as detailed further below. The motion is reciprocating since the rotating member 104 rotates.

Figure 7:
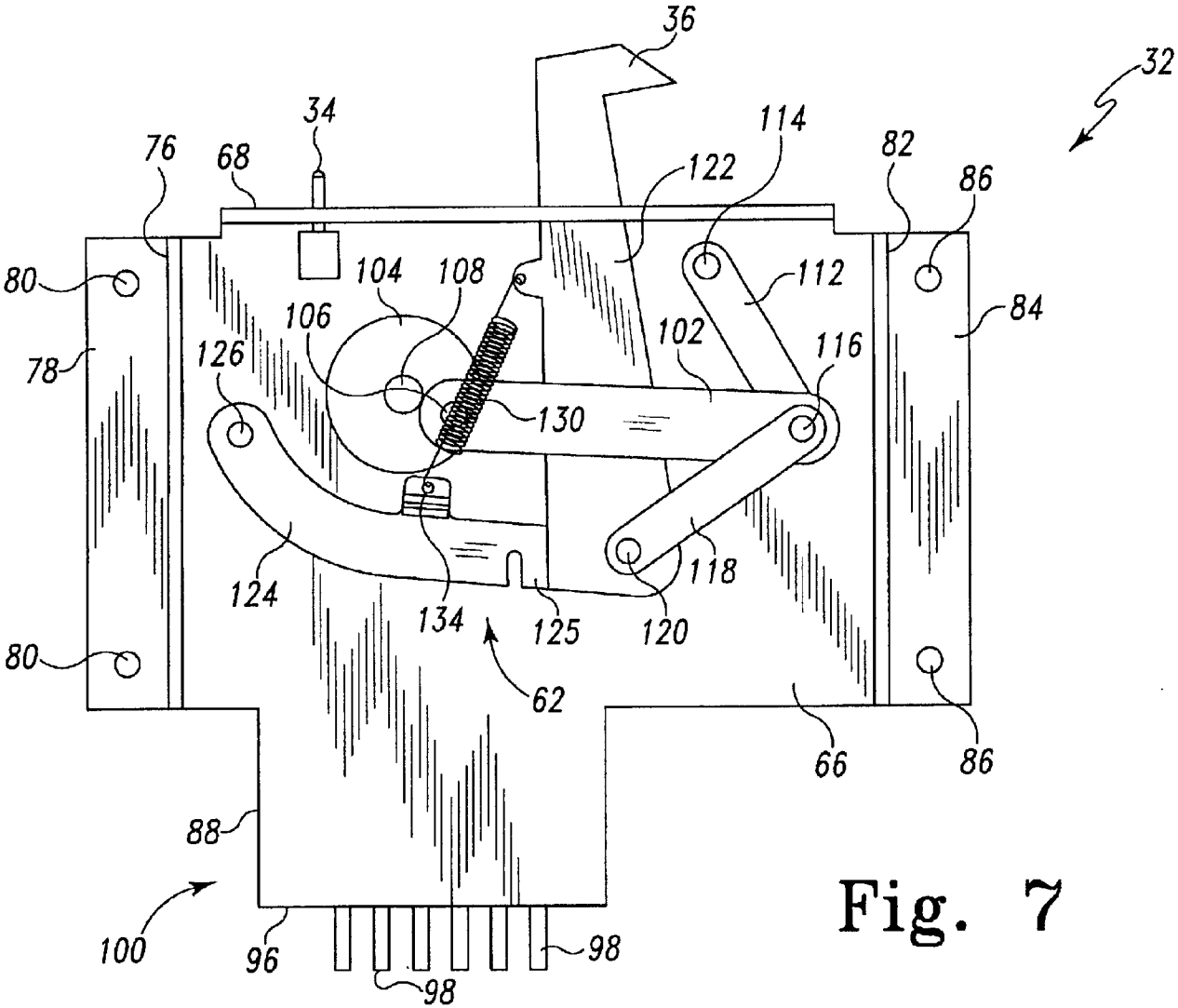
FIG. 7 is a bottom plan view of an exemplary door latch module showing positioning of latching linkage thereof when in a fully open or unlatched position.
Figure 8:
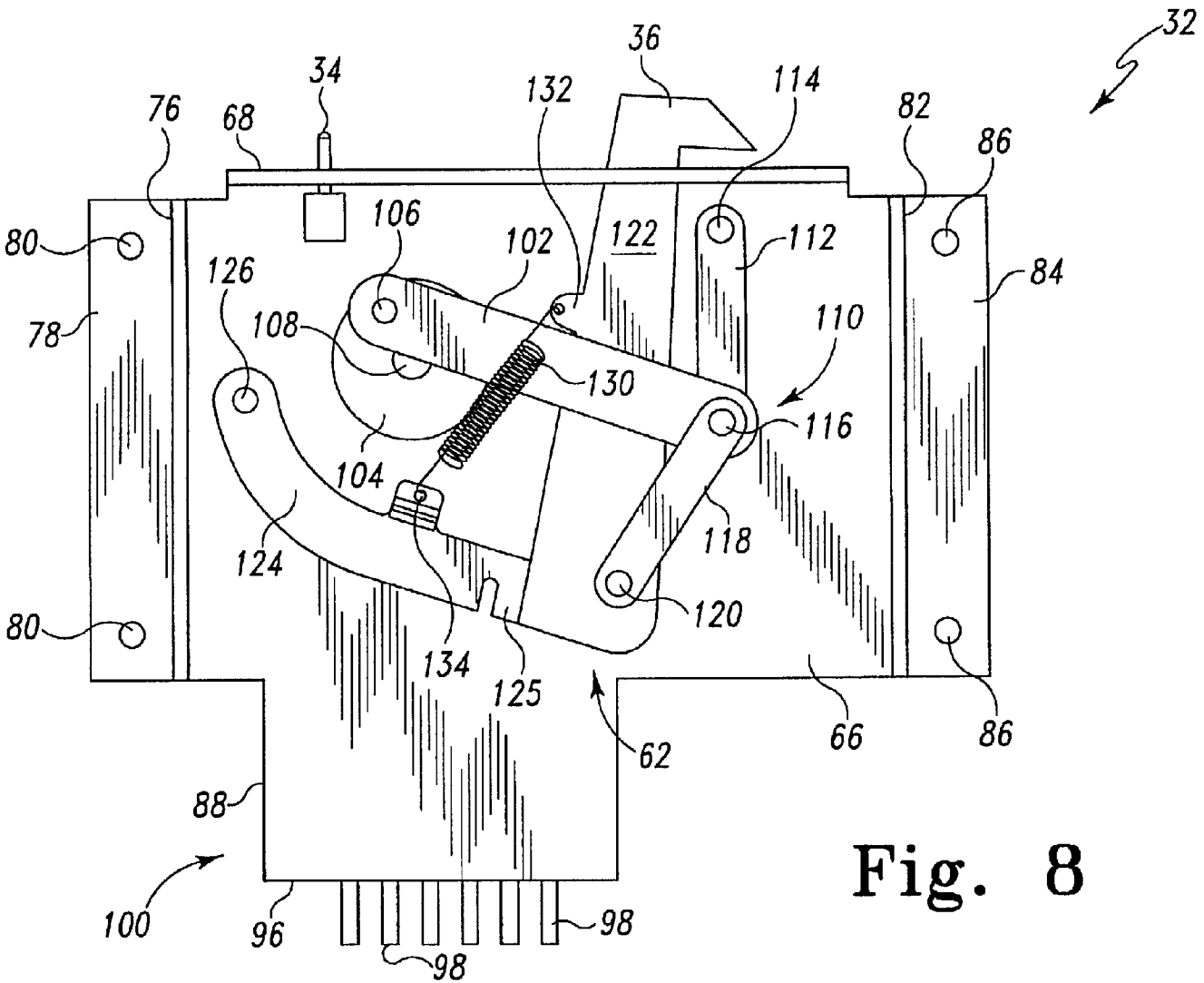
FIG. 8 is a bottom plan view of an exemplary door latch module showing positioning of the latching linkage thereof when in a fully closed or latched position.

With additional reference to FIGS. 7 and 8, it should be appreciated that the rotating member 104 rotates or is driven by the motor 64 in response to the oven 10 beginning, completing, or ending the cleaning cycle/mode. The rotating member 104 thus completes a full 360° rotation upon completion of the cleaning cycle/mode. Particularly, the position of the pivot 106 defines, in this example, a start position or 0°. This corresponds to the hook 36 being in a stowed or unlatched position as depicted in FIGS. 4 and 7. When the rotating member 104 has rotated 180° as depicted in FIG. 8, the hook 36 is in the latched position. The various angular positions of the rotating member 104 between 0° and 180°, and between 180° and 360° thus move the hook 36 into the next position.

The hook arm 122 includes a spring retainer 132 while the swing arm 124 includes a spring retainer 134. A biasing spring 130 (here a compression spring) is used to maintain the hook 36 in an unlatched position or pulled against the swing arm 125. In this manner, the hook arm 122 and thus the hook 36 are normally biased into an unlatched position.

The latching linkage 62 in accordance with an aspect of the subject invention thus moves the hook 36 from an unlatched position or mode to a latched position or mode and vice versa. The latching linkage 62 is thus operative, configured, and/or adapted to latch and unlatch the oven door 16 particularly during and after the cleaning cycle of the oven 10.

Figure 9:
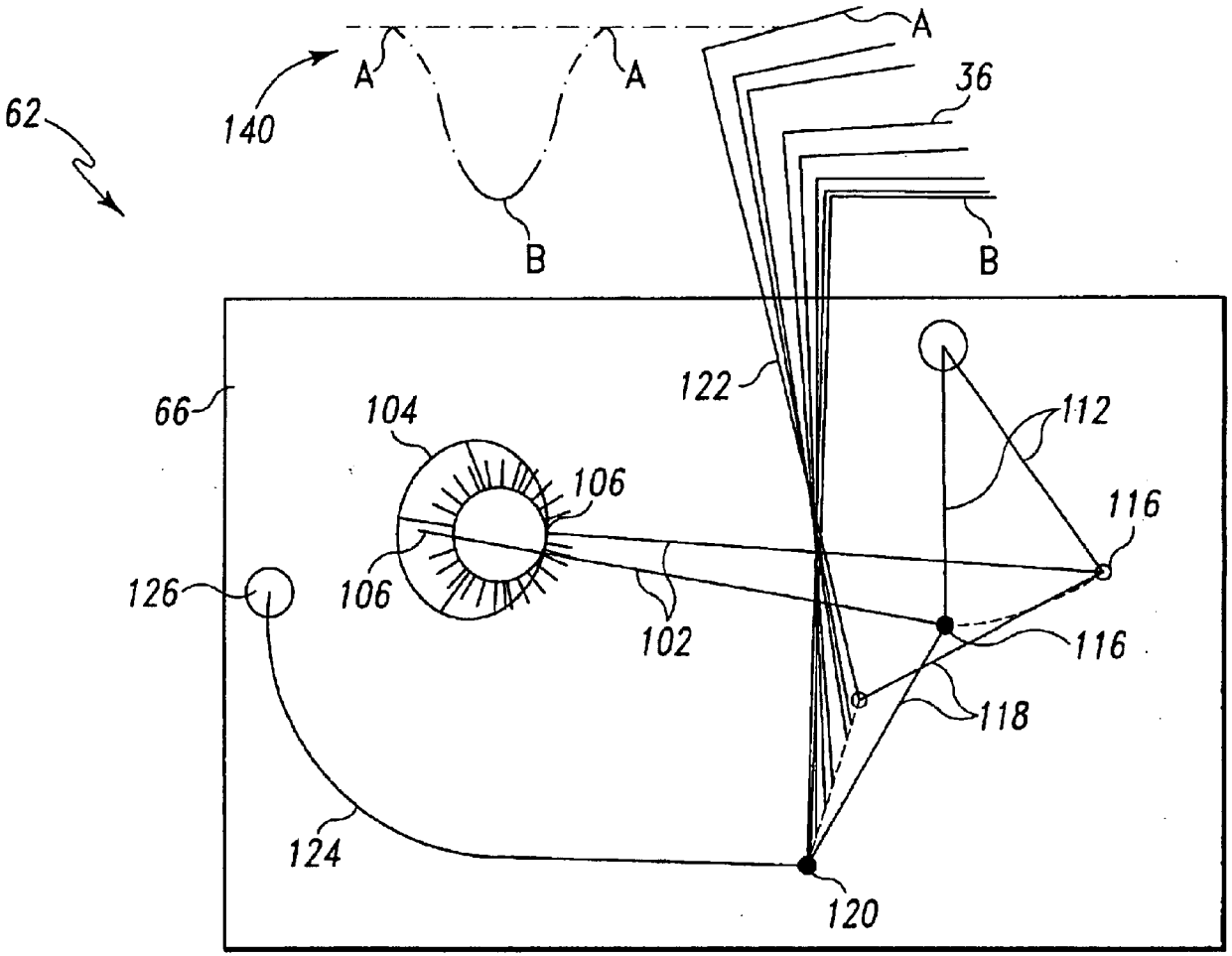
FIG. 9 is a schematic representation of the reciprocating motion of the latching linkage during a full cycle thereof.
Figure 10:
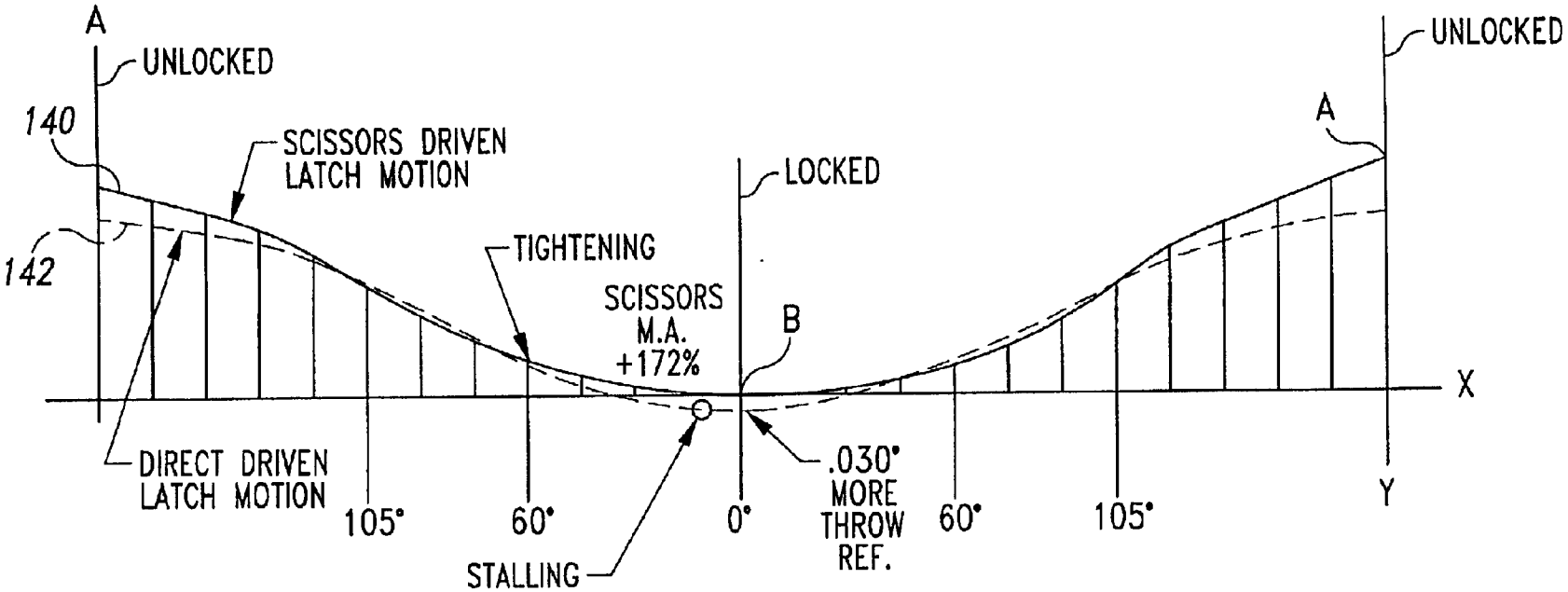
FIG. 10 is a graph of the representation of the reciprocating motion of the latching linkage depicted in FIG. 9 particularly illustrating the various positions of a hook associated with the latching linkage with respect to latching and unlatching an oven door and with respect to a typical oven door latch.
Figure 11:
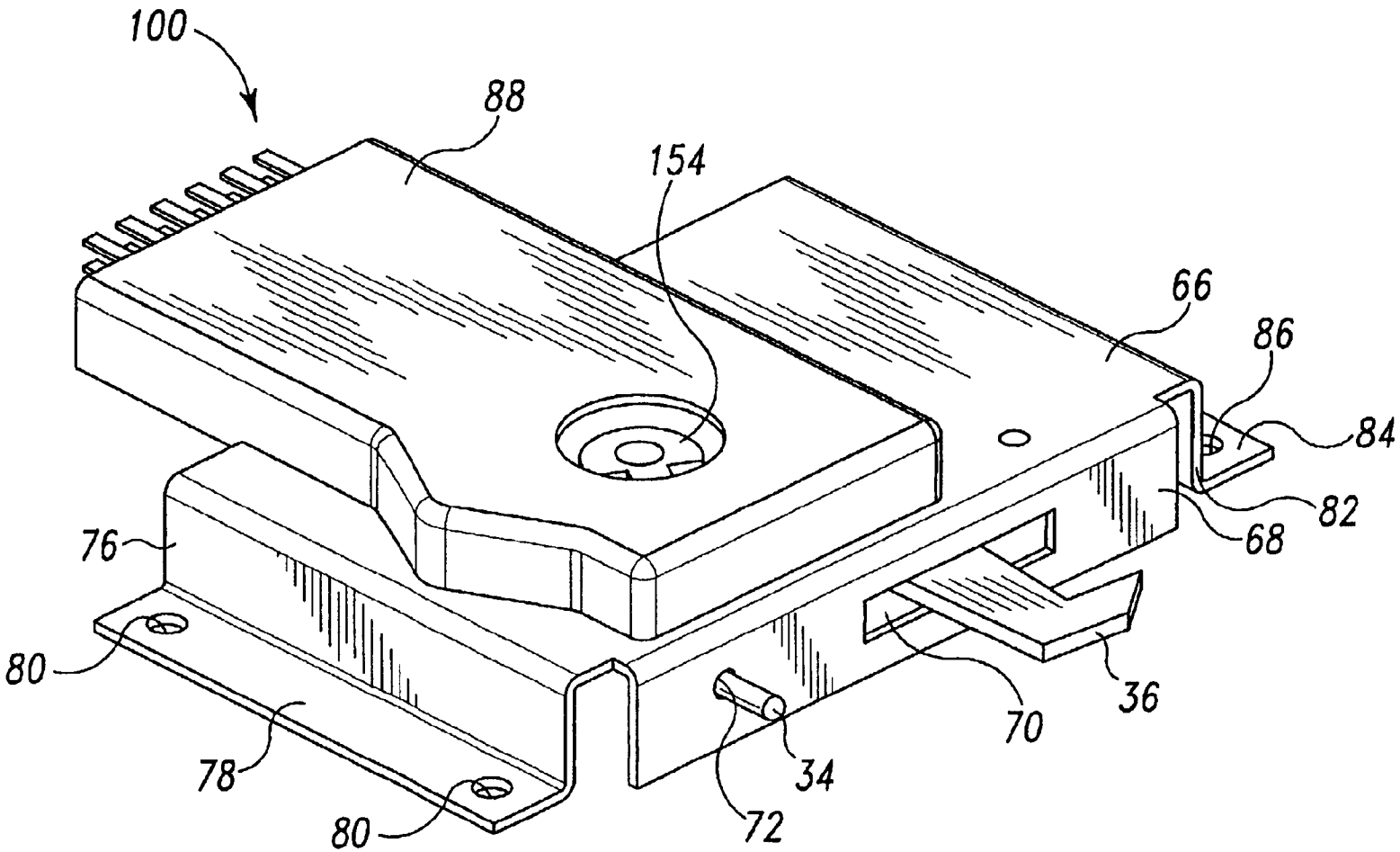
FIG. 11 is a top perspective view of an exemplary door latch module with the motor removed.
Figure 12:
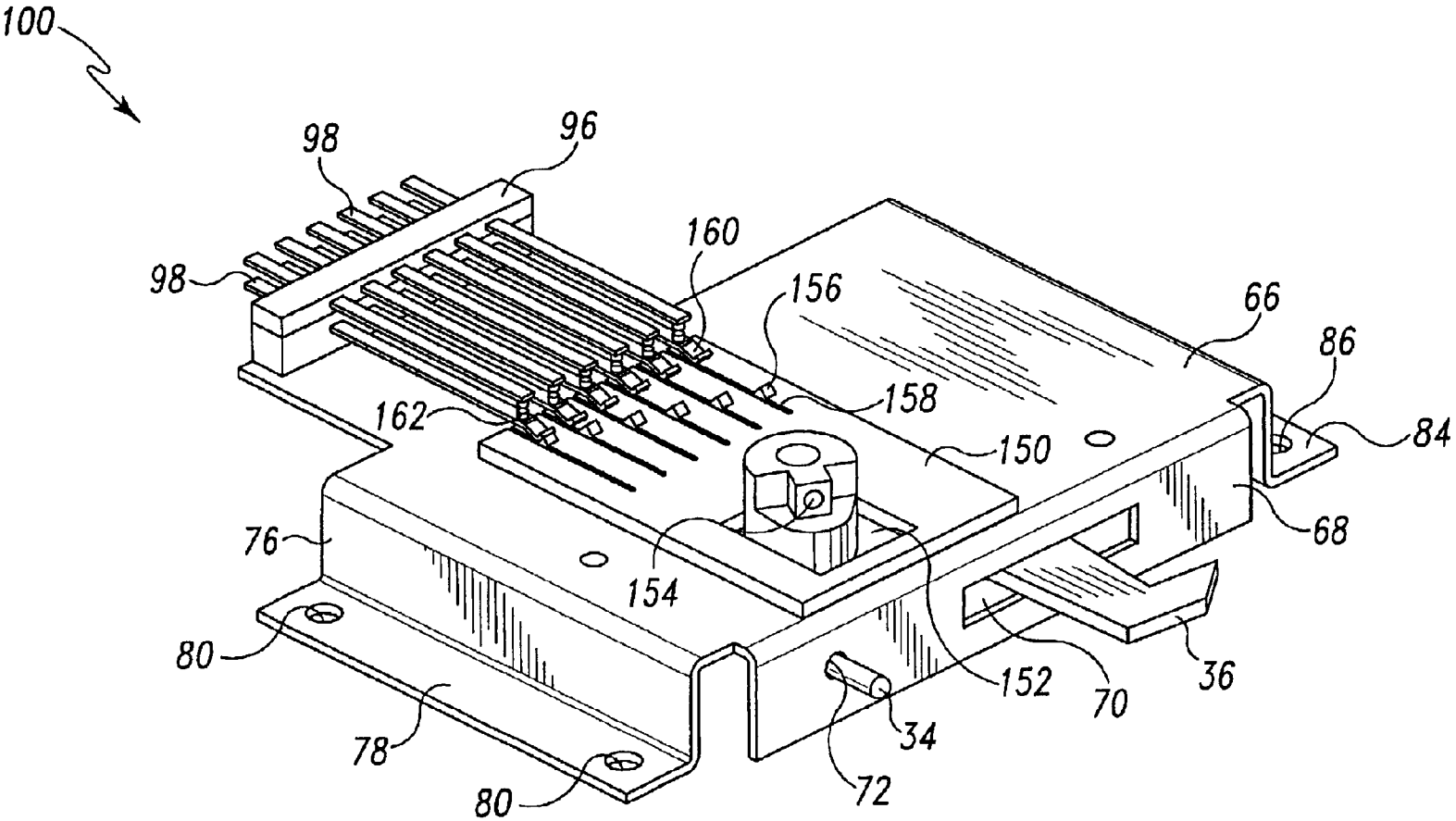
FIG. 12 is a top perspective view of an exemplary door latch module with the latching linkage in a fully open position and with the cover and motor removed particularly showing positioning of the cam and cam plate.

Referring to FIGS. 9 and 10 there is shown a representation of the movement of the latch mechanism 62. Particularly, the movement of the hook 36 relative to the rotational member 104 and the linkage components is shown and graphed for a full cleaning cycle or mode. In FIG. 9 it can be seen that the as the pivot point 106 rotates with the rotational member 104 (as driven by the motor 64) the hook 36 undergoes displacement in accordance with the hook movement/displacement curve 140 wherein position "A" corresponds to a full unlatched position, and position "B" corresponds to a full latched position. The latching linkage, including the scissors mechanism, floats when operating. The latching linkage is coupled to or part of the hook 36. The two arms of the embodiment of the scissors mechanism shown and described herein are pivotally coupled to one another at ends thereof in a free or floating manner (i.e. the pivot is not fixed relative to the arms). One arm of the scissors mechanism of the latching linkage is pivotally fixed at another end thereof to the support, while the other end of the other arm of the scissors mechanism is pivotally coupled to the hook member.

The curve 140 is graphed in FIG. 10 and reference is now made thereto. The curve 140 is graphed as displacement (the Y-axis) versus time (the X-axis). A second curve 142 for a prior art direct driven latch mechanism is also shown for comparison. The hook 36 starts in an unlatched or unlocked position, position "A". The scissors mechanism 110 causes the curve to begin tightening around 60°. At 0° (position "B", corresponding to the latched or locked position) the present hook 36 provides compressive latching with little displacement at or below the displacement reference (the X-axis). In contrast, the curve 142 indicates that stalling may start to occur at about 15° through 0° (during the locking position). Thereafter, the present hook 36 travels to an unlatched position, position "A". Again, in contrast, the curve 142 indicates that stalling may still occur during movement out of the locked position from 0° to about 15°.

Referring to FIG. 11–15 other aspects of the door latch module 32 will now be described. The door latch module 32 includes a m plate 150 that is driven by a cam 154. The cam 154 is, in turn, driven by the motor 64. The cam plate 150 is linearly movable on the plate 66 in accordance with the position of the cam within a cam opening 152 in the cam plate 150. As the motor 64 rotates, the cam 154 is likewise rotated. Rotation of the cam 154 linearly translates the cam plate 150 in a reciprocal movement.

The cam plate 150 includes a plurality of tracks, channels, or grooves 158 in which is disposed an actuator 156. Preferably, the actuators 156 are movably settable along their respective track 158. The number of tracks corresponds to the number of switches or terminal pairs of the bank of terminals 100. One set of terminals (here shown as the lower pair) includes actuators or prongs 160, while the other set of terminals (here the upper pair) includes contacts 162. The terminal pairs are spaced apart such appropriate movement of the lower terminal makes contact with the upper terminal to complete the switch. The lower terminal is caused to move upward when an actuator 156 is caused to move under a prong 160 through sliding movement of the cam plate 150.

The cam plate 150 moves as the latch linkage 62 moves. During this time various switches are preferably actuated by the actuators 156 to cause various signals to be generated to control various features and/or components. Since each actuator 156 is movable along its respective track 158, each switch, through its respective terminal pairs, may be controlled as to when it is actuated within the 360° rotation of the rotational member 104.

Figure 15:
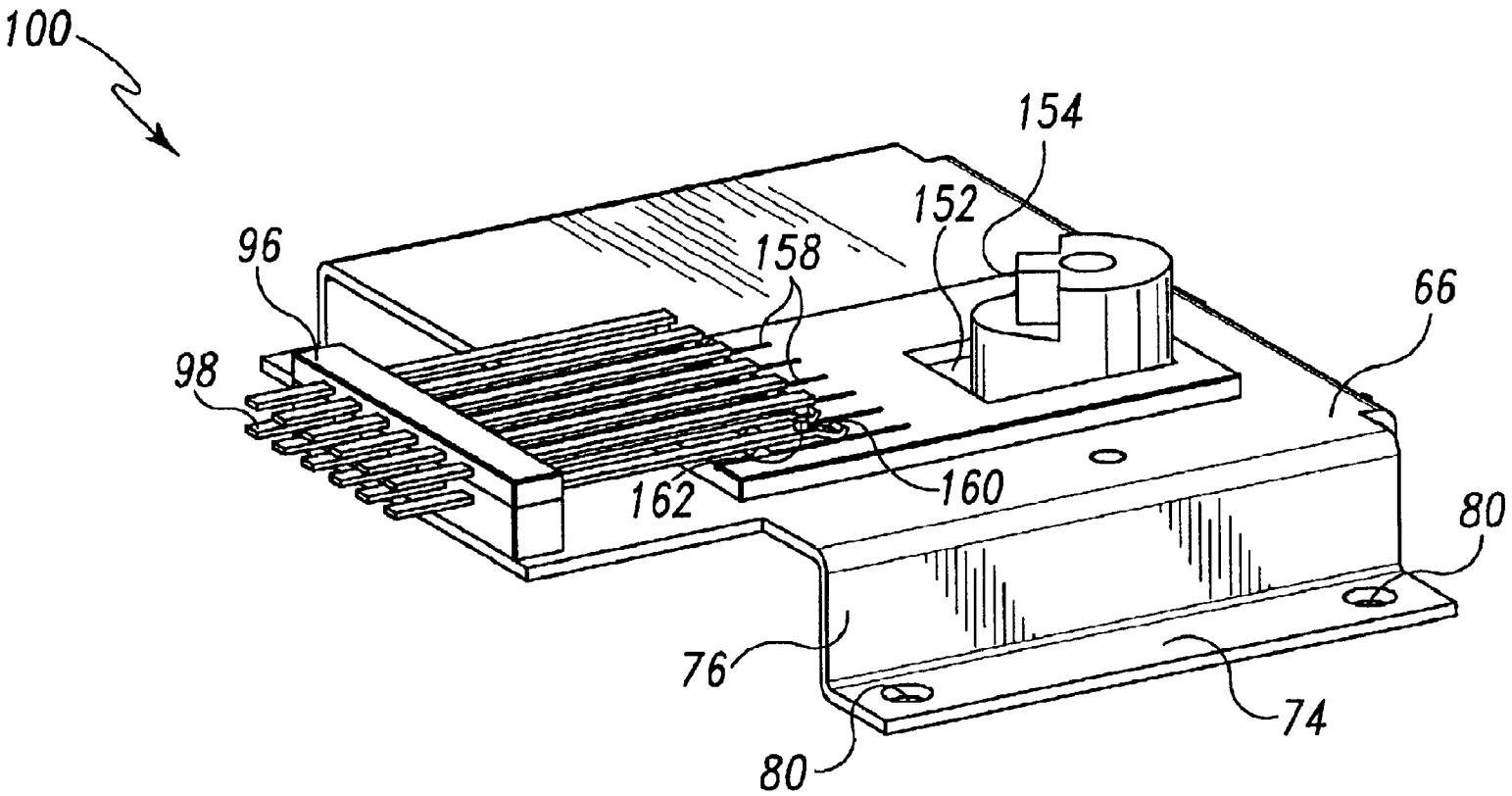
FIG. 15 is an enlarged side perspective view of an exemplary door latch module particularly showing the cam and cam plate relative to the switches when the cam and cam plate trace are in a closed or latched position.

In FIGS. 12–15, there is depicted the cam 154 and the cam plate 150 when the latch mechanism 62 is in the unlatched position (FIGS. 12 and 14) and the latched position (FIGS. 13 and 15). It can be seen that the cam plate 150 moves in a linear motion in response to the cam 154 between the unlatched position and the latched position. The cam plate 150 moves or reciprocates from one extreme position (unlatched) to another extreme position (latched), in response to a clean cycle mode or command. This can be equated with 0° through 180° (from the unlatched to the latched position) and from 180° to 360° (from the latched to the unlatched position). As well, it can be seen that the cam operated switches open and close in response to the cam actuators 156 associated with each switch. Rotational movement of the cam 154 from the motor 64 is translated into linear movement (translation) through the cam plate 150.

Figure 16:
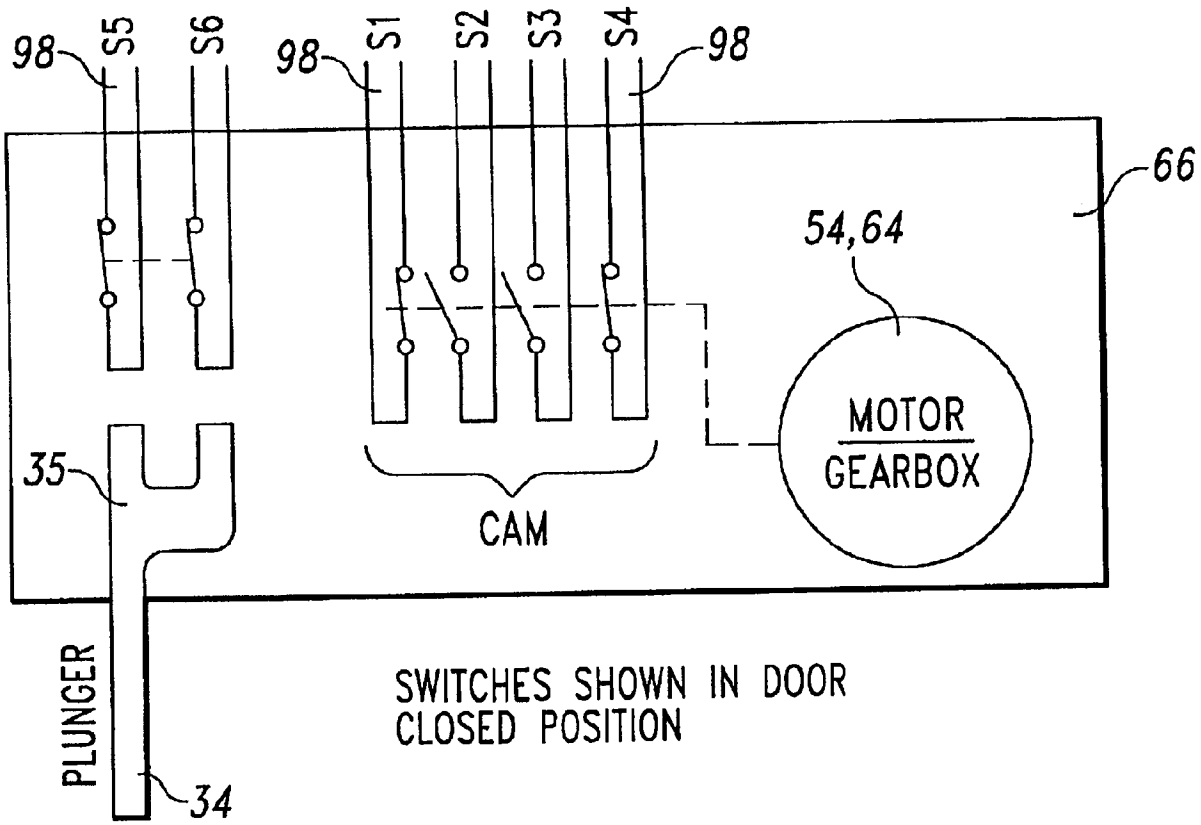
FIG. 16 is a schematic representation of an exemplary embodiment of the various switches of the door latch module particularly depicting the switches in a door closed position.

Referring to FIG. 16, there is depicted an exemplary schematic embodiment of various switches of the present door latching mechanism 32. In the exemplary embodiment of the door latching mechanism 32, there are six (6) switches generally labeled S1, S2, S3, S4, S5, and S6. Four (4) of the switches S1, S2, S3, and S4 are actuated by the cam 154 and cam plate 150 (collectively "cam actuated"), while two (2) of the switches S5 and S6 are actuated by the door position pin/switch 34/35. In FIG. 16, the switches are shown in a door closed position. The various switches S1–S4 are coupled to the controller 54 and/or motor 64 to provide selective actuation of the features/functions as described herein.

When the door 16 is closed, the door position pin (plunger) 34 actuates the door position switch 35 such that the switches S5 and S6 are closed. The cam operated switches S1, S2, S3, and S4 have been positioned as closed, open, open, and closed respectively, via the respective actuators 156 of the cam plate 150.

Figure 17:
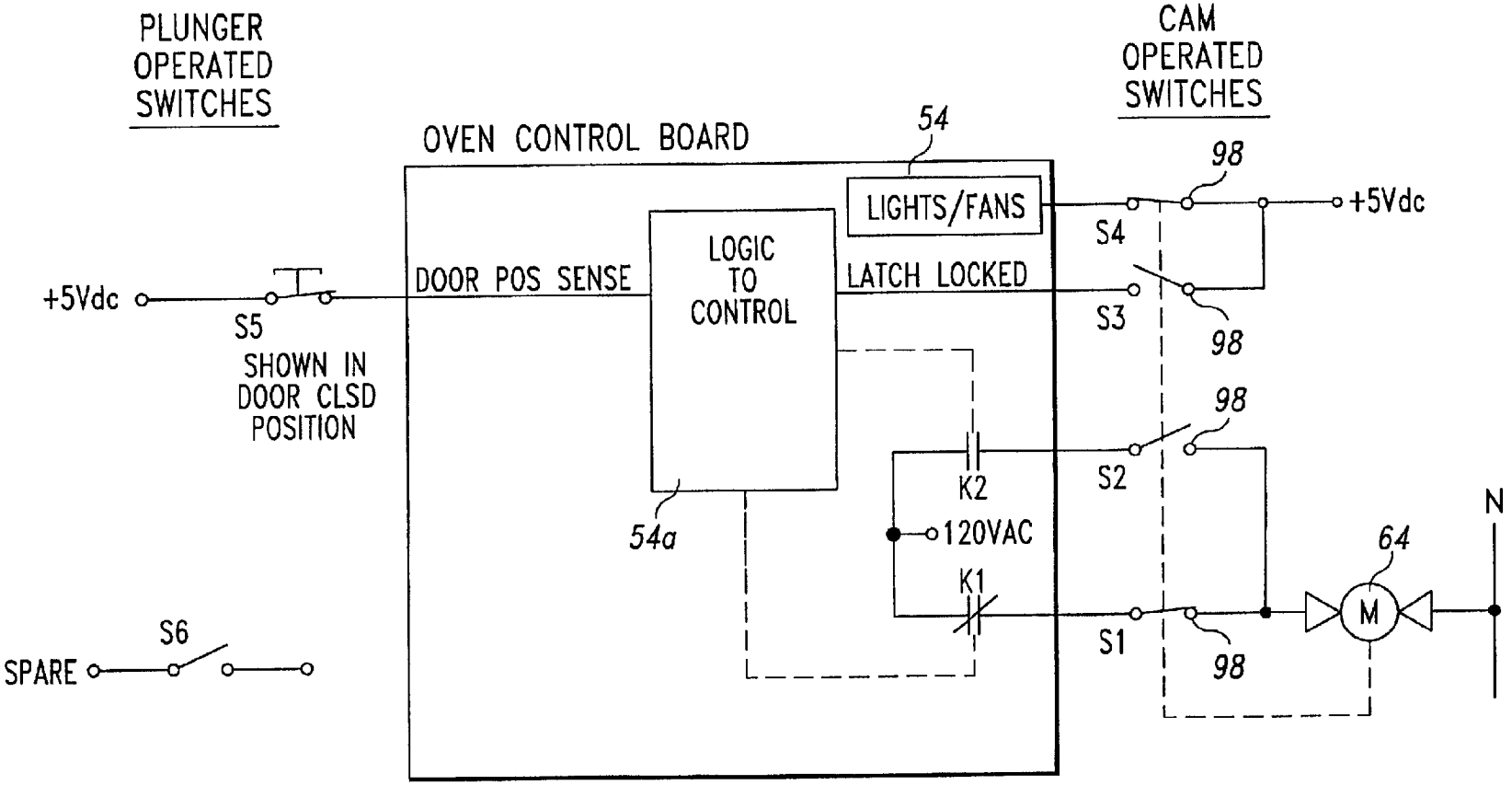
FIG. 17 is a schematic representation of an exemplary embodiment of the various switches of the door latch module coupled in relation to the oven controller and motor.

In FIG. 17, there is depicted a specific exemplary connection of the switches shown in FIG. 16. Particularly, the switch S5 provides a signal (via being in communication with a voltage source of +5 volts) to the controller 54 (control circuitry 54*a*) that the door 16 is closed. As well a cam operated switch S1 is closed to provide a signal from the control circuitry 54*a* to the motor 64 to move the latch linkage into the closed position. The switch S3 is not yet closed by an actuator 156 of the cam plate 150 which, when it does, provides a signal to the control circuitry 54*a* that the latch is locked. The switch S2 will close and the switch S1 will open when the latching linkage is to unlock the door 16. In this manner the motor 64 will then continue to drive the latching linkage and cam plate.

Figure 18:
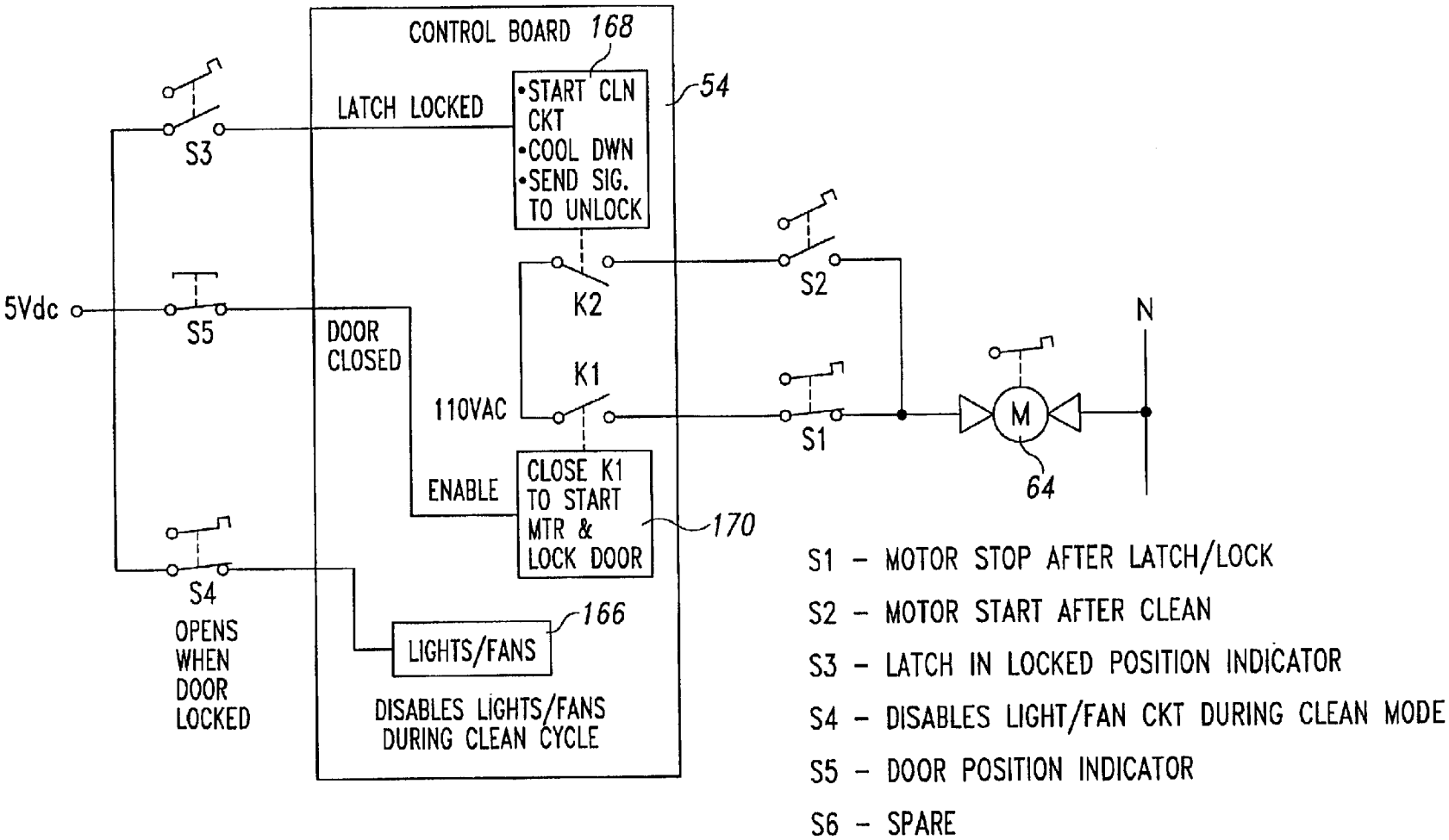
FIG. 18 is a schematic representation of another exemplary embodiment of the various switches of the door latch module coupled in relation to the oven controller and motor.

In FIG. 18, the particulars of the controller 54 for the schematic of FIG. 17 are shown in greater detail. Additionally, the switches are laid out differently for additional ease in understanding. The switch S4 provides a signal to lights and fans logic/circuitry 166 that is operative to disable the lights and/or fans of the oven 10 during the clean cycle. The switch S5 provides a door position indication signal to circuitry/logic 170 that is operative to open and close a contact K1 (such as a solenoid or the like) to respectively start and stop the motor 64 and lock and unlock the door 16. The switch S3 provides a latched locked position indication signal to circuitry/logic 168 that is operative to start the cleaning cycle, cool down during the cleaning cycle, and unlock the door 16. The circuitry/logic 168 actuates a contact K2 (such as a solenoid or the like) to allow the motor 64 to operate and not operate.

Figure 19:
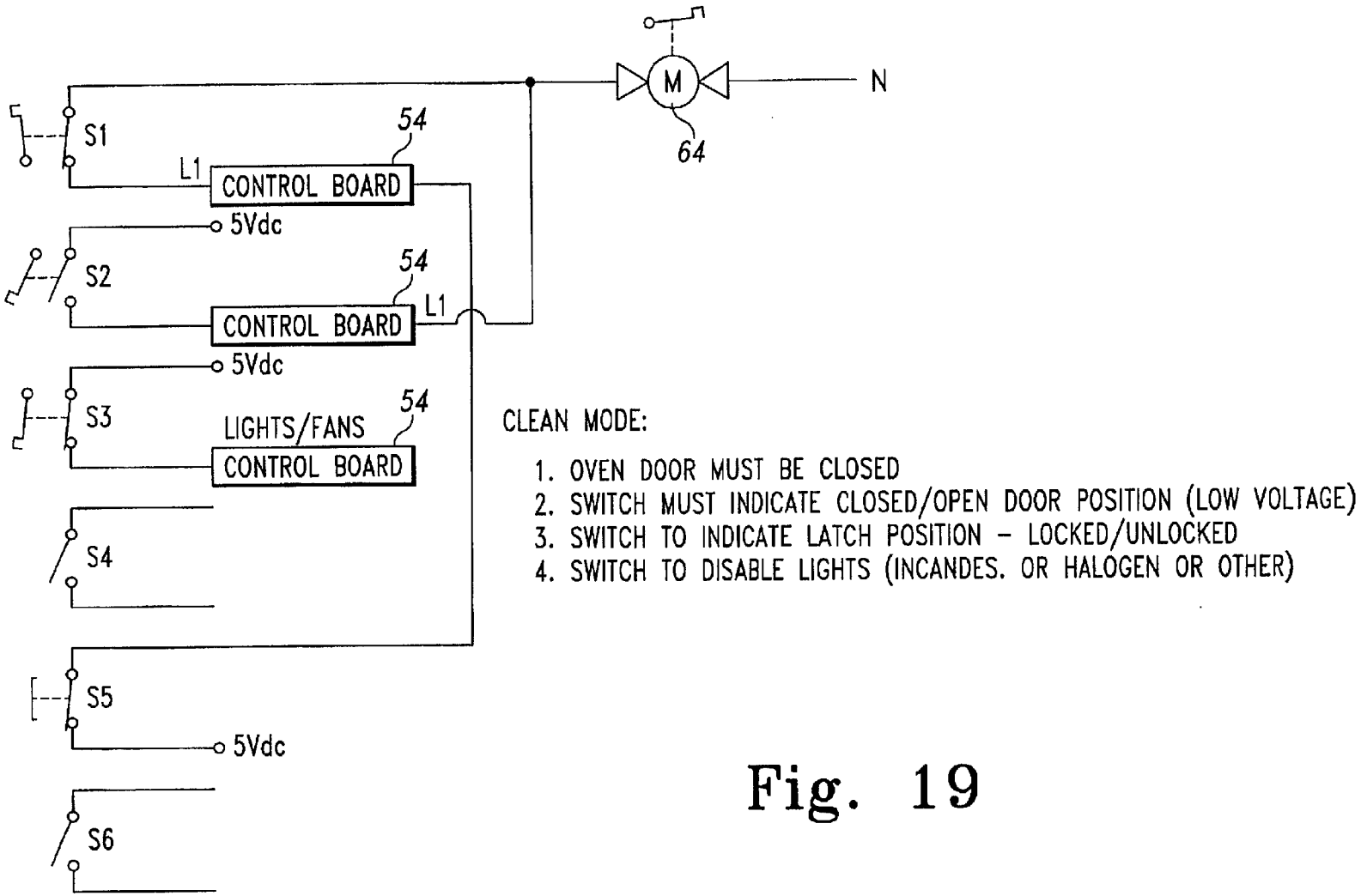
FIG. 19 is a schematic representation of an exemplary embodiment of the various switches of the door latch module particularly depicting the exemplary positioning of the switches and coupled in relation to the oven controller and the motor.

In FIG. 19, there is depicted another layout of the cam operated switches S1, S2, S3, and S4, and the door position operated switches S5 and S6 in relation to the controller 54 and the motor 64. The switches are shown in the clean mode with the legend in FIG. 19 indicating switch control/signal generation for the door latch module 32.

Figure 20:
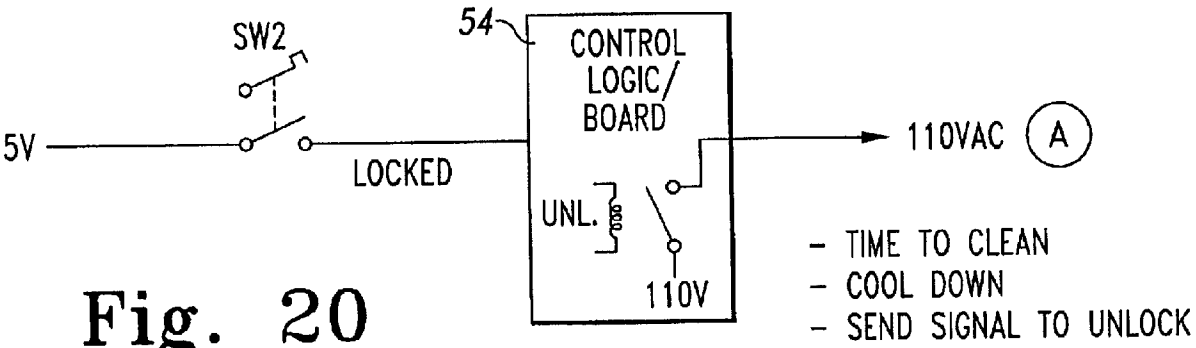
FIG. 20 is a schematic representation of an exemplary manner of coupling and the function and/or operation of a switch of the door latch module.

FIG. 20 illustrates another exemplary manner in which one of the switches, here switch S2 (SW2) provides a signal to the control logic 54. The switch S2 is a cam operated switch that indicates (via a signal) to the control logic 54 when it is time to clean, cool down, and generate and send a signal to unlock the door 16. It should be appreciated that the cam operated switches S1–S4 may open and close depending on the positioning of the respective actuator 156 and the movement of the cam plate 150.

Figure 21:
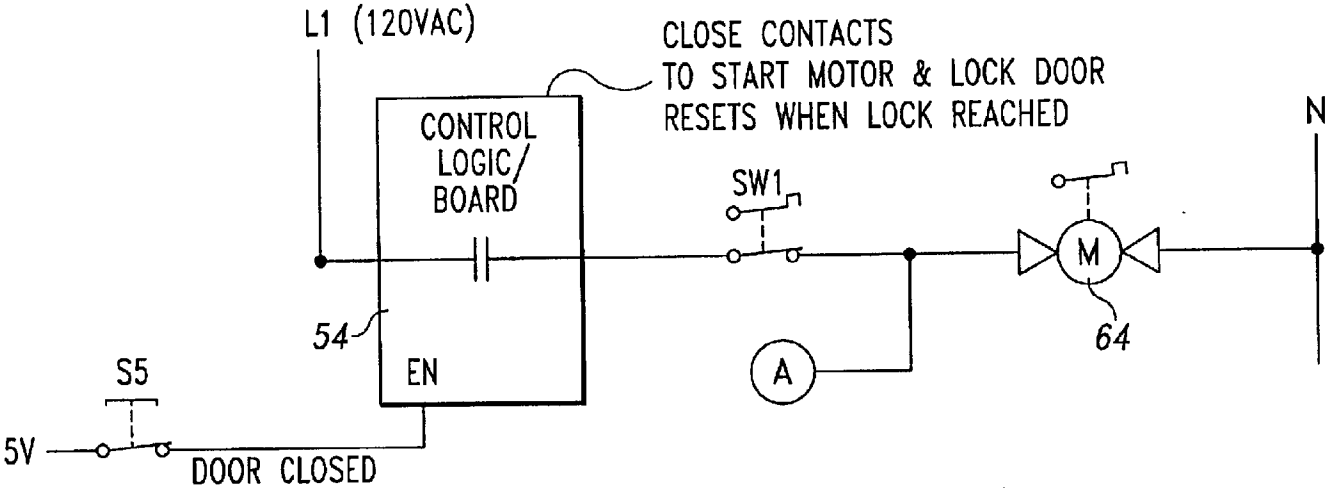
FIG. 21 is a schematic representation of an exemplary manner of coupling and the function and/or operation of a switch of the door latch module.

In FIG. 21, exemplary particulars are provided with regard to switch S5. Switch S5 is from the door position switch 35 and provides a door position signal to the controller 54. In FIG. 21, the switch S5 is closed indicating a door closed condition. This causes the controller 54 to close contacts to start the motor 64 and lock/latch the door 16 via the latching linkage. When switch S1 (a cam operated switch) closes while the switch S5 is closed, the motor 64 can thereafter start.

Figure 22:
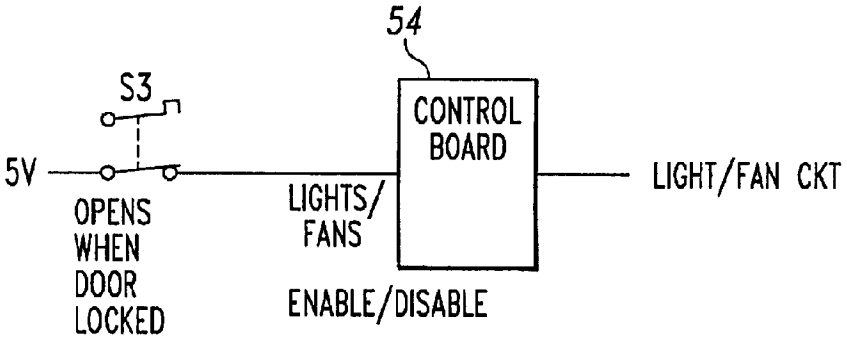
FIG. 22 is a schematic representation of an exemplary manner of coupling and the function and/or operation of a switch of the door latch module.

In FIG. 22 exemplary particulars are provided with regard to switch S3. Switch S3 is a cam operated switch and is opened when the door 16 unlocks or unlatches. The switch S3 provide a signal to the controller 54 regarding whether to enable or disable the light(s) and/or fan(s) and/or circuitry/logic thereof.

Figure 23A:
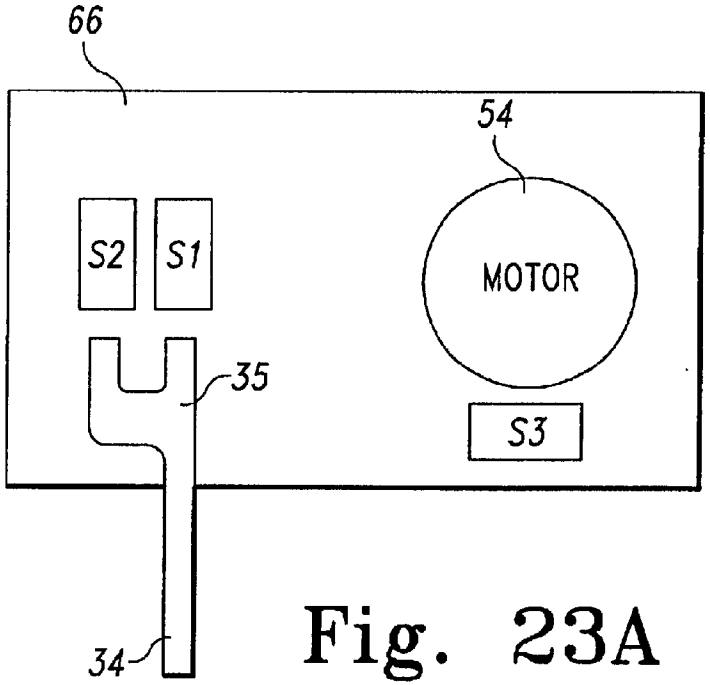
FIG. 23A is a schematic representation of an exemplary manner of coupling and the function and/or operation of a switch configuration of the door latching module.
Figure 23B:
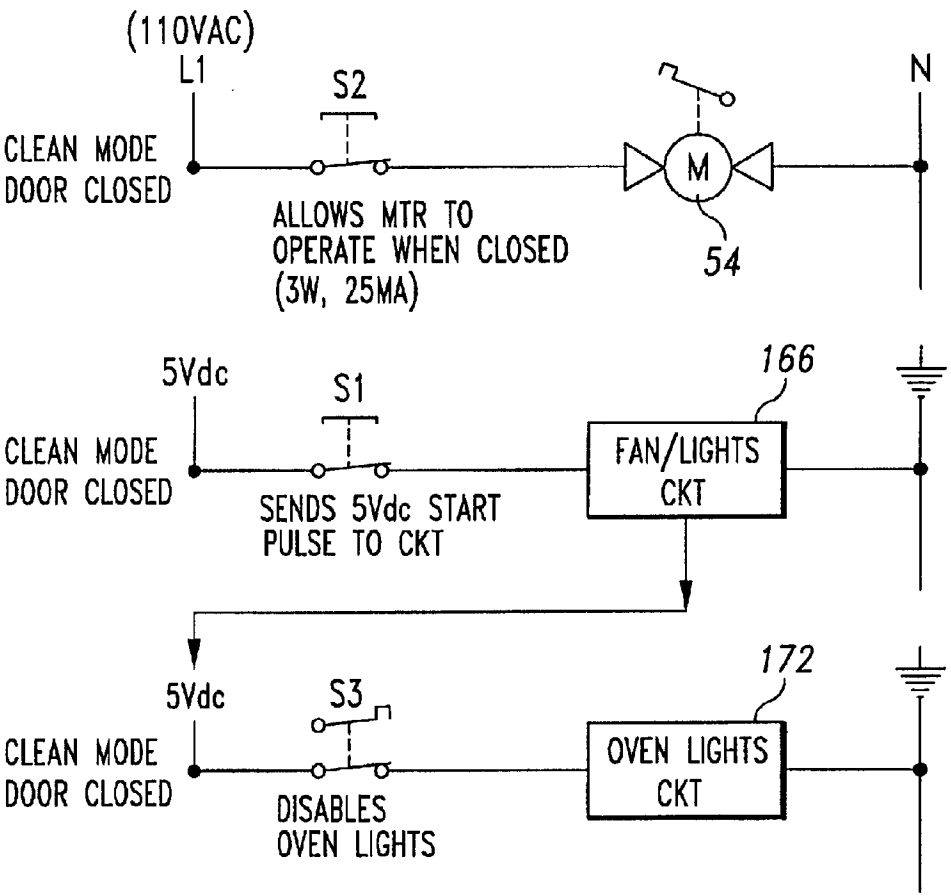
FIG. 23B is a schematic representation of the exemplary manner of coupling and the function and/or operation of the switch configuration of FIG. 23A.

Referring now to FIGS. 23A and 23B, there is provided another exemplary particular regarding the door actuated switches, here switches S1 and S2, and a cam operate switch S3. Particularly, the switches S1, S2, and S3 are shown in the clean mode or cycle. Switch S2 provides a signal to start and operate/run the motor 54 when the door 16 is closed. Switch S1 provides a door closed signal to the fan/light circuitry/logic 166. The fan/light circuitry/logic 166 provides a signal via switch S3, when closed as shown, to oven light(s) circuitry/logic 172 to disable the oven lights.

It should be appreciated that the schematics of FIGS. 16–23 are exemplary of a manner in which the switches of the present door latch module 32 may be wired and function/operate. Other wiring may be used and is contemplated to carry out the various functions, features, and or operations described herein.

In sum, the door latch module 32 is operative to move the hook 36 from a stowed or unlatched position to a locked or latched position through actuation of the motor 64 via latch linkage in communication with the motor 64 and part of the hook 36. Various switches associated with the door latch module 32 are actuated by the motor 64 via a cam and cam plate.

While this invention has been described as having a preferred design, the subject invention can be further modified within the spirit and scope of this disclosure. This application is therefore intended to cover any variations, uses, or adaptations of the subject invention using its general principles. Further, this application is intended to cover such departures from the present disclosure as come within known or customary practice in the art to which this invention pertains and that fall within the limits of the appended claims.

What is claimed is:

1. A latch assembly for a self-cleaning oven, comprising:

a support;

a motor supported by said support;

a cam rotatably driven by said motor;

a latch mechanism driven by said motor;

a plurality of switches supported by said support; and a cam follower having an opening defined therein, said cam being received within said opening, said cam follower also including cam plate having a plurality of tracks, and a plurality of switch actuators respectively disposed within said plurality of tracks, wherein rotational movement of said cam causes a reciprocating linear translation of said cam follower, and wherein said reciprocating linear translation of said cam follower causes actuation of at least one of said plurality of switches.

2. The latch assembly of claim 1, wherein said cam follower is mechanically interposed said cam and said plurality of switches.

3. The latch assembly of claim 1, wherein said plurality of switch actuators are respectively movably settable long said plurality of tracks.

4. The latch assembly of claim 1, wherein:

said cam follower includes a rim that defines aid opening therein, and said cam contacts said rim during rotational movement of said cam so as to urge said cam follower in a reciprocating path of movement.

5. A latch assembly for a self-cleaning oven, comprising:

a support;

a motor supported by said support;

a cam rotatably driven by said motor;

a latch mechanism driven by said motor;

a plurality of switches supported by said support, said plurality of switches includes an upper set of switch arms and a lower set of switch arms, and a cam follower having an opening defined therein, said cam being received within said opening, wherein rotational movement of said cam causes a reciprocating linear translation of said cam follower causing at least one upper arm of said upper set of switch arms and a respective of at least one lower arm of said lower set of switch arms to contact each other.

6. The latch assembly of claim 5, wherein:

said upper set of switch arms includes a plurality of upper terminals aligned in a first row, said lower set of switch arms includes plurality of lower terminals aligned in a second row, and said second row is positioned below said first row.

7. The latch assembly of claim 5, wherein:

said support includes a housing having an opening defined therein, said latch mechanism is positioned in said housing, and said latch mechanism includes a latch arm that extends through said opening defined in said housing.

8. A latch assembly for a self-cleaning oven, comprising:

a latch housing;

a motor supported by said latch housing;

a cam rotatably driven by said motor;

a cam follower having an opening defined therein, wherein (i) said cam is received within said opening, and (ii) rotational movement of said cam causes a reciprocating linear translation of said cam follower;

a latch mechanism driven by said motor, said latch mechanism being located within said latch housing; and a plurality of switches supported by said latch housing, wherein (i) said plurality of switches includes an upper set of switch arms and a lower set of switch arms, and (ii) said reciprocating linear translation of said cam follower causes one of said upper set of switch arms and one of said lower set of switch arms to contact each other.

9. The latch assembly of claim 8, wherein:

said upper set of switch arms includes a plurality of upper terminals aligned in a first row, said lower set of switch arms includes a plurality of lower terminals aligned in a second row, and said second row is positioned below said first row.

10. The latch assembly of claim 8, wherein said cam follower includes:

a cam plate having a plurality of tracks, and a plurality of switch actuators respectively disposed within said plurality of tracks.

11. The latch assembly of claim 10, wherein said plurality of switch actuators are respectively movably settable along said plurality of tracks.

12. The latch assembly of claim 8, wherein:

said cam follower includes a rim that defines said opening therein, and said cam contacts said rim during rotational movement of said am so as to urge said cam follower in a reciprocating path of movement.

13. A self-cleaning oven, comprising:

an oven frame;

a motor housing secured to said oven frame;

a motor supported by said latch housing;

a cam rotatably driven by said motor;

a cam follower having an opening defined therein, wherein (i) said cam is received within said opening, and (ii) rotational movement of said cam causes a reciprocating linear translation of said cam follower;

a latch mechanism driven by said motor, said latch mechanism being located within said latch housing; and a plurality of switches supported by said latch housing, said plurality of switches includes an upper set of switch arm and a lower set of switch arms, and said reciprocating linear translation of said cam follower cause at least one upper arm of said upper set of switch arms and a respective at least one lower arm of said lower set of switch arm to contact each other.

14. The self-cleaning oven of claim 13, wherein:

said cam follower includes a rim that defines said opening therein, and said cam contacts said rim during rotational movement of said cam so as to urge said cam follower in a reciprocating path of movement.

15. A self-cleaning oven, comprising:

an oven frame;

a latch housing secured to said oven frame;

a motor supported by said latch housing;

a cam rotatably driven by said motor;

a cam follower includes (i) a cam late having a plurality of tracks, and (ii) a plurality of switch actuators respectively disposed within said plurality of tracks, said cam follower having an opening defined therein, wherein (i) said cam is received within said opening, and (ii) rotational movement of said cam causes a reciprocating linear translation of said cam follower;

a latch mechanism driven by said motor, said latch mechanism being located within said latch housing; and a plurality of switches supported by said latch housing, wherein said reciprocating linear translation of said cam follower causes actuation of at least one of said plurality of switches.

16. The self-cleaning oven of claim 15, wherein:

said cam follower includes a rim that defines said opening therein, and said cam contacts said rim during rotational movement of said cam so as to urge said cam follower in a reciprocating path of movement.

* * * * *